US009575462B2

(12) United States Patent
Sato

(10) Patent No.: US 9,575,462 B2
(45) Date of Patent: Feb. 21, 2017

(54) IMAGE FORMING APPARATUS PROVIDED WITH PROCESS CARTRIDGE AND TONER CARTRIDGE DETACHABLY MOUNTABLE THEREIN

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/069,106

(22) Filed: Mar. 14, 2016

(65) Prior Publication Data

US 2016/0291538 A1 Oct. 6, 2016

(30) Foreign Application Priority Data

Mar. 31, 2015 (JP) ..... 2015-073409

(51) Int. Cl.
*G03G 15/08* (2006.01)
*G03G 21/18* (2006.01)

(52) U.S. Cl.
CPC ..... *G03G 21/1817* (2013.01); *G03G 15/0839* (2013.01)

(58) Field of Classification Search
CPC ..... G03G 21/18; G03G 15/0839
See application file for complete search history.

(56) References Cited

U.S. PATENT DOCUMENTS 7,106,995 B2 * 9/2006 Nagai ..... G03G 15/0894 399/109
7,274,894 B2 * 9/2007 Sato ..... G03G 21/1835 399/110

FOREIGN PATENT DOCUMENTS

JP 2005-167801 A 6/2005

* cited by examiner

*Primary Examiner* — Hoang Ngo
(74) *Attorney, Agent, or Firm* — Banner & Witcoff, Ltd.

(57) ABSTRACT

An image forming apparatus includes: a main casing including a cover; a process cartridge including a second toner conveying part; a transfer belt; a toner cartridge including a first toner conveying part; a secondary transfer member; and a fixing unit. The cover opens and closes an opening of the main casing by pivotally moving about a pivot axis. The transfer belt and toner cartridge are positioned upward of the process cartridge. The secondary transfer member contacts the one end of the transfer belt. The pivot axis and fixing unit are closer to the one end than to the other end of the transfer belt in the orthogonal direction. The second toner conveying part has a second opening in communication with a first opening of the first toner conveying part. The second opening is opposite the developing roller with respect to the photosensitive drum in the orthogonal direction.

14 Claims, 12 Drawing Sheets

3

IMAGE FORMING APPARATUS PROVIDED WITH PROCESS CARTRIDGE AND TONER CARTRIDGE DETACHABLY MOUNTABLE THEREIN

CROSS REFERENCE TO RELATED APPLICATION

This application claims priority from Japanese Patent Application No. 2015-073409 filed Mar. 31, 2015. The entire content of the priority application is incorporated herein by reference.

TECHNICAL FIELD

The present disclosure relates to an electrophotographic type image forming apparatus, and a process cartridge mountable in the image forming apparatus.

BACKGROUND

An intermediate transfer type image forming apparatus has been known as an electrophotographic type image forming apparatus. The intermediate transfer type image forming apparatus includes a process cartridge provided with a photosensitive drum, and a transfer belt in contact with the photosensitive drum. A toner image formed on the surface of the photosensitive drum is transferred onto the transfer belt, and then the toner image is transferred onto a sheet from the transfer belt.

As such a type of image forming apparatus, there has been proposed an image forming apparatus including a process kit provided with a photosensitive drum and a developing unit, an intermediate transfer belt positioned on the process kit, a toner container positioned beside the intermediate transfer belt and accommodating toner to be supplied to the developing unit, a secondary transfer roller in contact with a front end portion of the intermediate transfer belt, and a fixing unit positioned above the secondary transfer roller.

This image forming apparatus is configured to remove the process kit from the apparatus in a diagonally upward and forward direction by upwardly retracting the intermediate transfer belt away from the process kit after the fixing unit and the secondary transfer roller are retracted forward away from the intermediate transfer belt.

SUMMARY

In view of the foregoing, it is an object of the disclosure to provide an improved image forming apparatus and a process cartridge mountable in the image forming apparatus.

In order to attain the above and other objects, according to one aspect, the disclosure provides an image forming apparatus including: a main casing; a process cartridge; a transfer belt; a toner cartridge; a secondary transfer member; a fixing unit; a first toner conveying part; and a second toner conveying part. The main casing has an opening. The main casing includes a cover configured to pivotally move about a pivot axis to open and close the opening. The process cartridge is detachably mountable in the main casing. The process cartridge includes a photosensitive drum and a developing roller. The transfer belt is positioned upward of the process cartridge and in contact with the photosensitive drum when the process cartridge has been mounted in the main casing. The transfer belt has one end and another end in an orthogonal direction orthogonal to a vertical direction and an axial direction of the photosensitive drum. The pivot axis is positioned closer to the one end of the transfer belt than to the another end of the transfer belt in the orthogonal direction. The toner cartridge is configured to accommodate toner to be supplied to the process cartridge and detachably mountable in the main casing. The toner cartridge is positioned upward of the process cartridge when the process cartridge and the toner cartridge have been mounted in the main casing. The secondary transfer member is in contact with the one end of the transfer belt. The fixing unit includes a heating body and a pressure body. The fixing unit is positioned closer to the one end of the transfer belt than to the another end of the transfer belt in the orthogonal direction. The first toner conveying part is provided at the toner cartridge and has a first opening. The second toner conveying part is provided at the process cartridge and has a second opening configured to communicate with the first opening. The second opening is positioned opposite the developing roller with respect to the photosensitive drum in the orthogonal direction.

According to another aspect, the disclosure provides a process cartridge detachably mountable in an image forming apparatus and including a developing roller and a photosensitive drum. The image forming apparatus includes: a main casing; a transfer belt; a toner cartridge; a secondary transfer member; and a fixing unit. The main casing has an opening. The main casing includes a cover configured to pivotally move about a pivot axis to open and close the opening. The transfer belt is positioned upward of the process cartridge and in contact with the photosensitive drum when the process cartridge has been mounted in the main casing. The transfer belt has one end and another end in an orthogonal direction orthogonal to a vertical direction and an axial direction of the photosensitive drum. The pivot axis is positioned closer to the one end of the transfer belt than to the another end of the transfer belt in the orthogonal direction. The toner cartridge is configured to accommodate toner to be supplied to the process cartridge and detachably mountable in the main casing. The toner cartridge is positioned upward of the process cartridge when the process cartridge and the toner cartridge have been mounted in the main casing. The toner cartridge includes a first toner conveying part having a first opening. The secondary transfer member is in contact with the one end of the transfer belt. The fixing unit includes a heating body and a pressure body. The fixing unit is positioned closer to the one end of the transfer belt than to the another end of the transfer belt in the orthogonal direction. The process cartridge is detachably mountable in the main casing and further includes a second toner conveying part having a second opening. The second opening is configured to communicate with the first opening and positioned opposite the developing roller with respect to the photosensitive drum.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
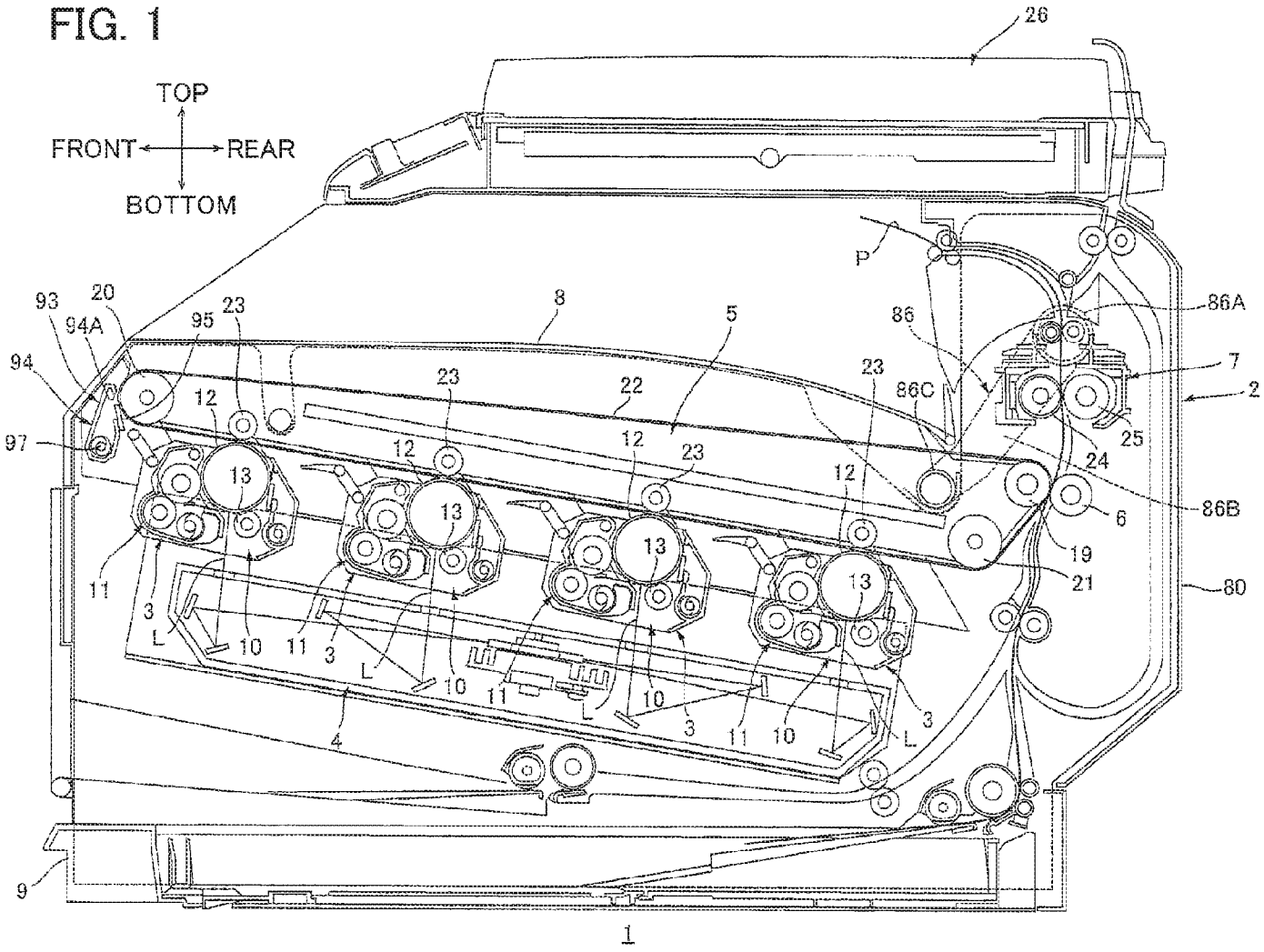
FIG. 1 is a central cross-sectional view of an image forming apparatus according to one embodiment.

An image forming apparatus 1 according to one embodiment will be described with reference to the accompanying drawings, wherein like parts and components are designated by the same reference numerals to avoid duplicating description. Directions referred to in the following description are based on directions indicated in the drawings.

1. Overall Structure of Image Forming Apparatus

As shown in FIG. 1, the image forming apparatus 1 is a laser printer. The image forming apparatus 1 includes a main casing 2 formed with an opening 2A (FIG. 12); a plurality of (four) process cartridges 3; a plurality of (four) toner cartridges 18 (FIG. 9); a scanning unit 4; a belt unit 5; a secondary transfer roller 6 as an example of a secondary transfer member; a fixing unit 7; and a reading unit 26.

The main casing 2 is box-shaped, and is provided with a cover 8 and a supply tray 9.

Figure 12:
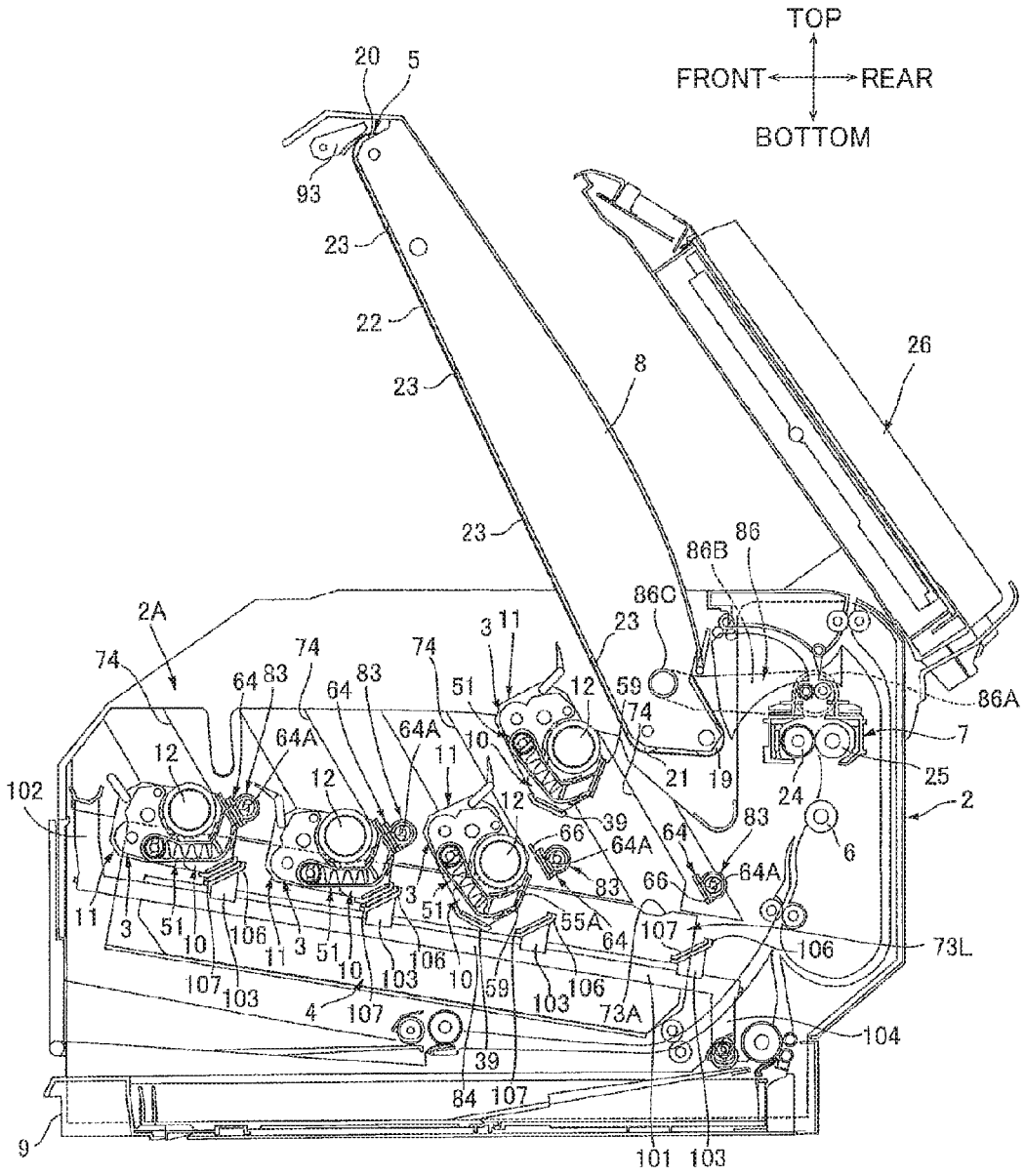
FIG. 12 is a view illustrating how the process cartridge is mounted in and removed from a main casing of the image forming apparatus according to the embodiment.

As shown in FIG. 12, the opening 2A is positioned at an upper end portion of the main casing 2 to provide communication between an interior and exterior of the main casing 2 in a vertical direction. The opening 2A allows the plurality of process cartridges 3 to pass therethrough.

As shown in FIG. 1, the cover 8 is disposed at the upper end portion of the main casing 2. The cover 8 has a plate shape that is elongated in a front-rear direction (an example of an orthogonal direction). The cover 8 is supported at an upper end portion of the belt unit 5. The cover 8 is pivotally movable together with the belt unit 5 about an axis of shaft parts 86A of a pivot member 86 (described later) between an open position opening the opening 2A (FIG. 12) and a closed position closing the opening 2A (FIG. 1). The pivot axis of the cover 8 (i.e. axis of the shaft parts 86A) is positioned rearward of the cover 8.

The supply tray 9 is disposed at a lower end portion of the main casing 2. The supply tray 9 is configured to accommodate sheets P.

Figure 3A:
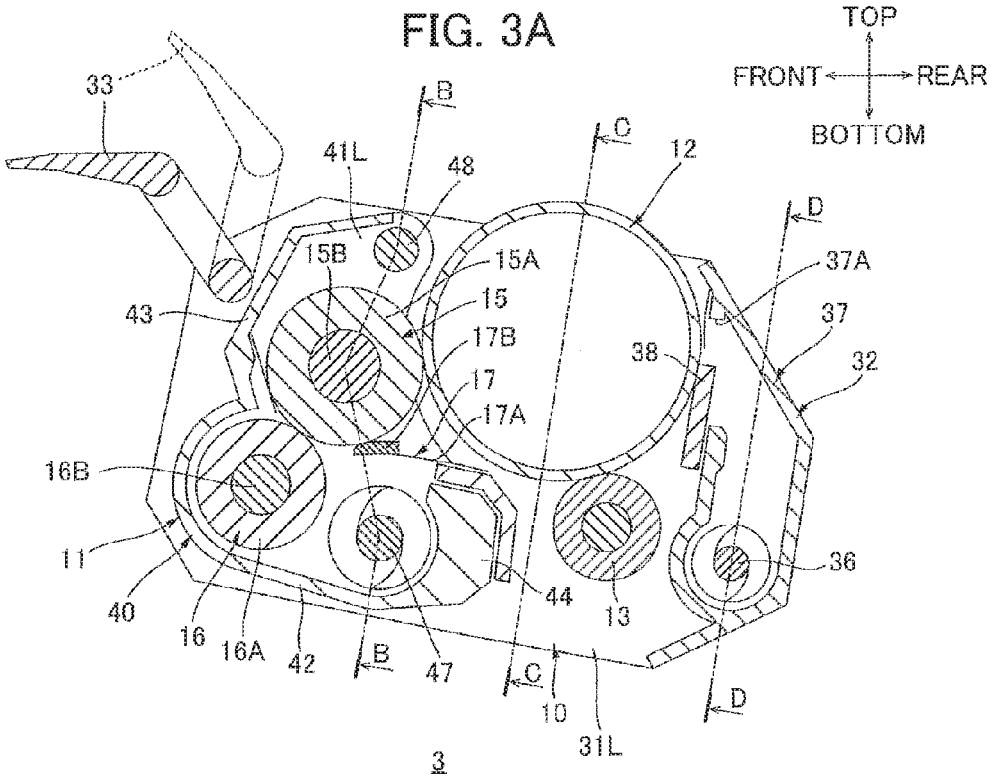
FIG. 3A is a central cross-sectional view of a process cartridge provided in the image forming apparatus shown in FIG. 1.

The plurality of process cartridges 3 is detachable from and attachable to the main casing 2. When attached to the main casing 2, the four process cartridges 3 are arrayed in the front-rear direction with a space between neighboring process cartridges 3. Each process cartridge 3 can be detached from the main casing 2 to an outside through the opening 2A as shown in FIG. 12. As shown in FIG. 3A, each of the four process cartridges 3 includes a drum unit 10 and a developing unit 11.

The drum unit 10 includes a photosensitive drum 12 and a charging roller 13 as an example of a charging member.

The photosensitive drum 12 is positioned at an upper end portion of the drum unit 10. The photosensitive drum 12 has a cylindrical shape that extends in a left-right direction (an example of an axial direction).

The charging roller 13 is positioned downward of the photosensitive drum 12. The charging roller 13 is in contact with a lower end portion of the photosensitive drum 12. The charging roller 13 is configured to charge a surface of the photosensitive drum 12.

The developing unit 11 is positioned diagonally forward and downward of the photosensitive drum 12. The developing unit 11 includes a developing roller 15, a supply roller 16, and a blade 17.

The developing roller 15 is positioned at an upper end portion of the developing unit 11. The developing roller 15 is in contact with a front end portion of the photosensitive drum 12. The developing roller 15 is configured to supply toner to the photosensitive drum 12.

The supply roller 16 is positioned diagonally forward and downward of the developing roller 15. The supply roller 16 is in contact with a lower-front end portion of the developing roller 15. The supply roller 16 is configured to supply toner to the developing roller 15.

The blade 17 is positioned diagonally rearward and downward of the developing roller 15. The blade 17 is in contact with a lower-rear end portion of a roller portion 15A (described later) of the developing roller 15. The blade 17 is configured to regulate a thickness of a toner layer formed over a surface of the developing roller 15.

Figure 2:
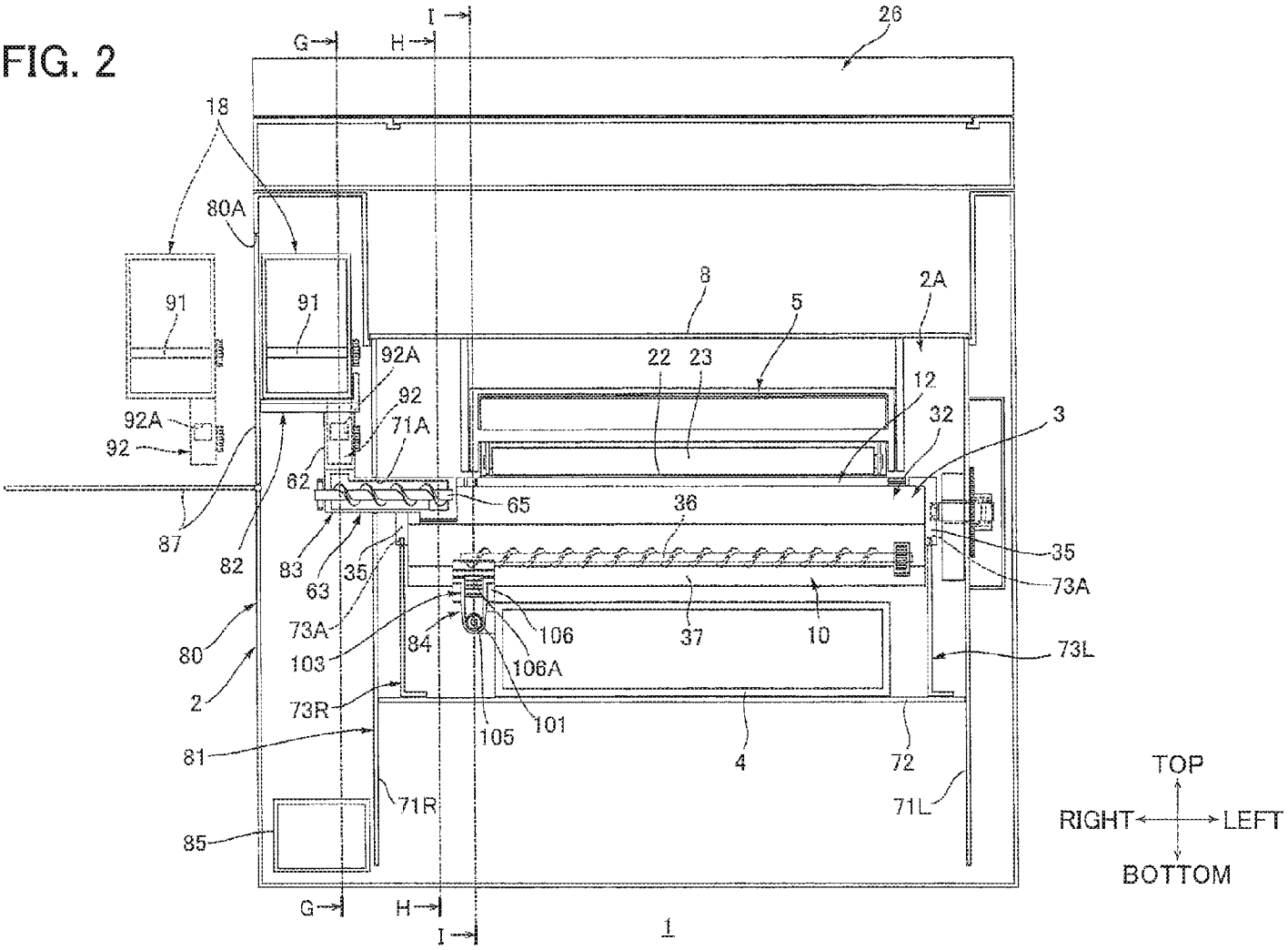
FIG. 2 is a cross-sectional view of the image forming apparatus shown in FIG. 1 and taken along a line A-A in FIG. 10.
Figure 9:
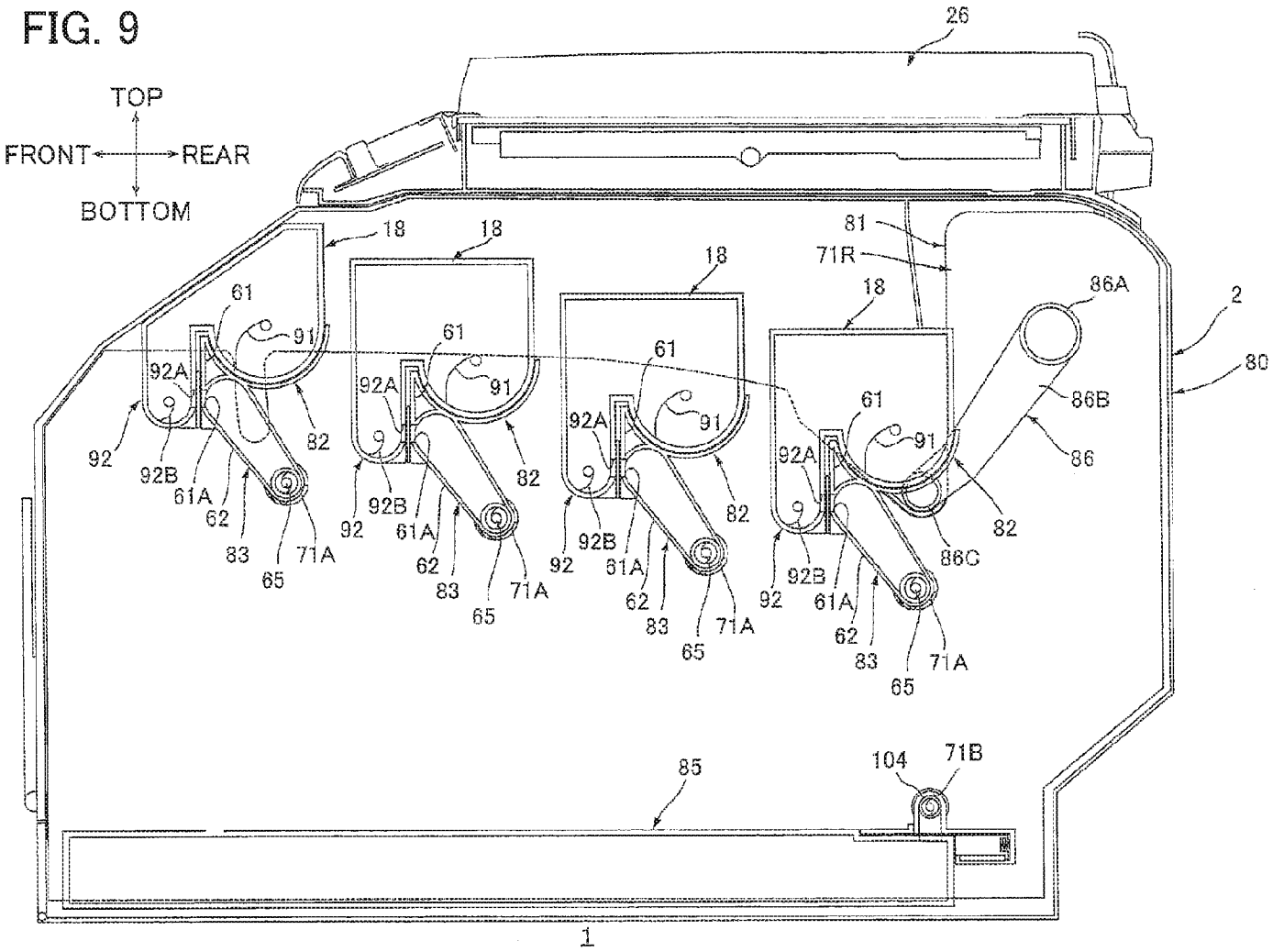
FIG. 9 is a cross-sectional view of the image forming apparatus taken along a line G-G in FIG. 2.

As shown in FIGS. 2 and 9, the plurality of toner cartridges 18 are positioned diagonally upward and rightward of the plurality of process cartridges 3, respectively. The plurality of toner cartridges 18 is detachable from and attachable to the main casing 2. In a state where the process cartridges 3 and the toner cartridges 18 are attached to the main casing 2, the toner cartridges 18 are positioned upward of the corresponding process cartridges 3. Each of the toner cartridges 18 is generally box-shaped having a bottom wall formed in an arcuate shape. Each toner cartridge 18 is configured to accommodate therein toner. Toner accommodated in the toner cartridge 18 is conveyed to the corresponding developing unit 11.

As shown in FIG. 1, the scanning unit 4 is positioned downward of the four process cartridges 3. The scanning unit 4 is configured to irradiate a laser beam L based on image data. The laser beam L is incident on the surface of each photosensitive drum 12, passing between the developing unit 11 and the corresponding charging roller 13.

The belt unit 5 is positioned upward of the four process cartridges 3 when the process cartridges 3 are attached to the main casing 2. The belt unit 5 extends in the front-rear direction. The belt unit 5 includes a first roller 19 positioned at a rear end portion of the belt unit 5; a second roller 20 positioned at a front end portion of the belt unit 5; a third roller 21 positioned diagonally forward and downward of the first roller 19; a transfer belt 22; and a plurality of (four) primary transfer rollers 23.

The transfer belt 22 is looped over the first roller 19, the second roller 20, and the third roller 21. The transfer belt 22 has a lower portion that is in contact with the four photosensitive drums 12. The transfer belt 22 is circularly movable around the first roller 19, the second roller 20, and the third roller 21 such that the lower portion of the transfer belt 22 is moved rearward.

The four primary transfer rollers 23 are arrayed in the front-rear direction between the second roller 20 and the third roller 21, with a space between neighboring primary transfer rollers 23. The primary transfer rollers 23 are positioned upward of the corresponding photosensitive drums 12, with the transfer belt 22 interposed therebetween.

The secondary transfer roller 6 is positioned rearward of the first roller 19. The secondary transfer roller 6 is in contact with a rear end portion (an example of one end in the orthogonal direction) of the transfer belt 22. The secondary transfer roller 6 nips the transfer belt 22 in cooperation with the first roller 19.

The fixing unit 7 is positioned upward of the rear end portion of the transfer belt 22 and the secondary transfer roller 6. That is, the fixing unit 7 is positioned closer to the rear end portion of the transfer belt 22 than to a front end portion of the transfer belt 22 in the front-rear direction. The fixing unit 7 includes a heating roller 24 as an example of a heating body, and a pressure roller 25 as an example of a pressure body in pressure contact with the heating roller 24.

The reading unit 26 is positioned above the main casing 2. More specifically, the reading unit 26 is positioned upward of the cover 8 with a gap therebetween. The reading unit 26 is a flat-bed type image scanner. The reading unit 26 is configured to read image data from an original document.

Upon start of an image-forming operation in the image forming apparatus 1, the scanning unit 4 irradiates the laser beam L, so that the surfaces of the photosensitive drums 12 are exposed to the laser beam L. Thus, electrostatic latent images based on image data are formed on the surfaces of the photosensitive drums 12, respectively.

Then, toner is supplied onto the electrostatic latent images on the surfaces of the photosensitive drums 12 by the corresponding developing rollers 15. Thus, toner images are carried on the surfaces of the respective photosensitive drums 12.

Then, the toner images on the surfaces of the photosensitive drums 12 are transferred onto the transfer belt 22.

In the meantime, the sheets P are supplied from the supply tray 9 one at a prescribed timing to a position between the transfer belt 22 and the secondary transfer roller 6. The toner image on the transfer belt 22 is transferred onto the sheet P when the sheet P passes between the transfer belt 22 and the secondary transfer roller 6.

Subsequently, the sheet P is heated and pressed when the sheet P passes between the heating roller 24 and the pressure roller 25. Thus, the toner image carried on the sheet P is thermally fixed onto the sheet P.

Then, the sheet P is delivered onto the cover 8.

2. Process Cartridge

Figure 8A:
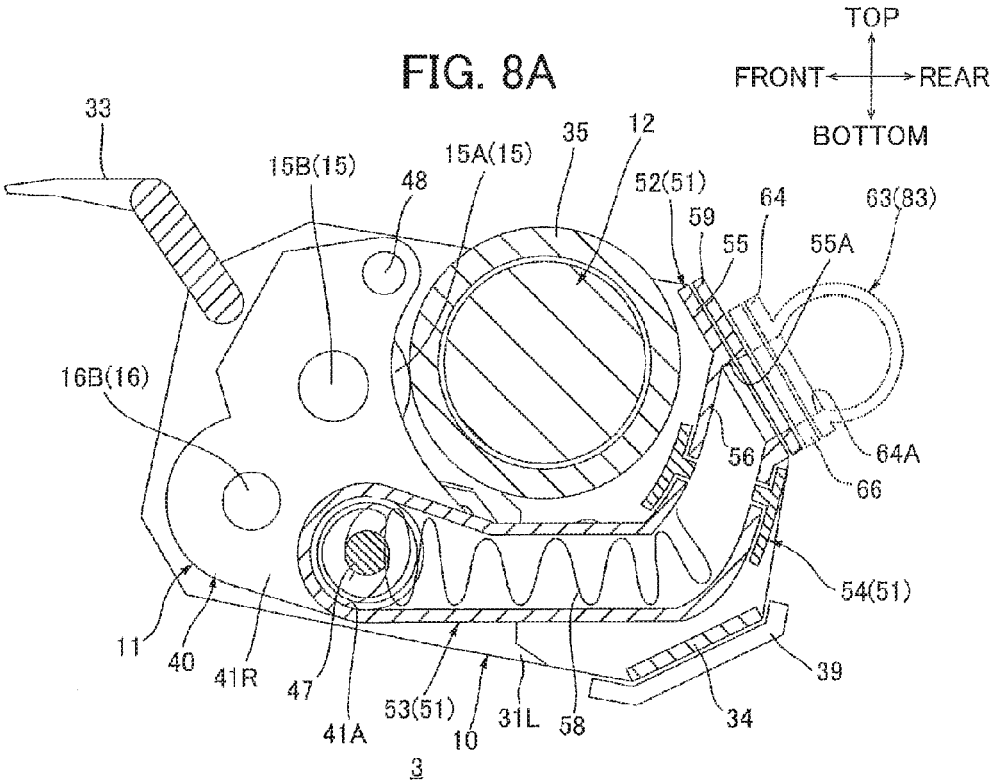
FIG. 8A is a cross-sectional view of the process cartridge taken along a line E-E in FIG. 6.

As shown in FIGS. 3A and 8A, each of the process cartridges 3 includes the drum unit 10, the developing unit 11, and a second toner conveying part 51.

(1) Drum Unit

Figure 3B:
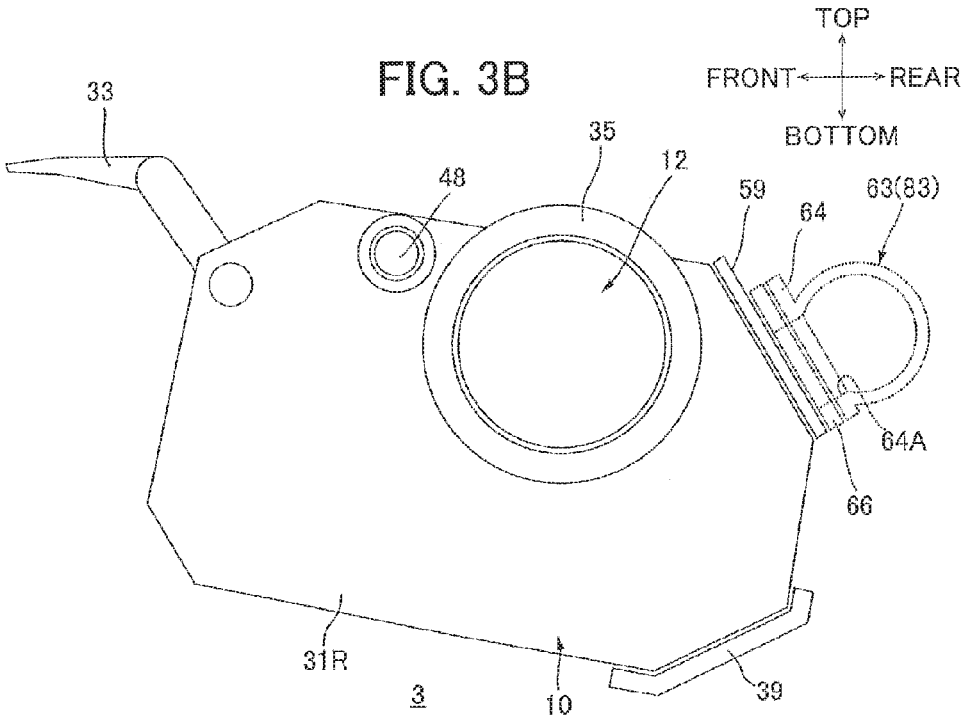
FIG. 3B is a right side view of the process cartridge shown in FIG. 3A.
Figure 5:
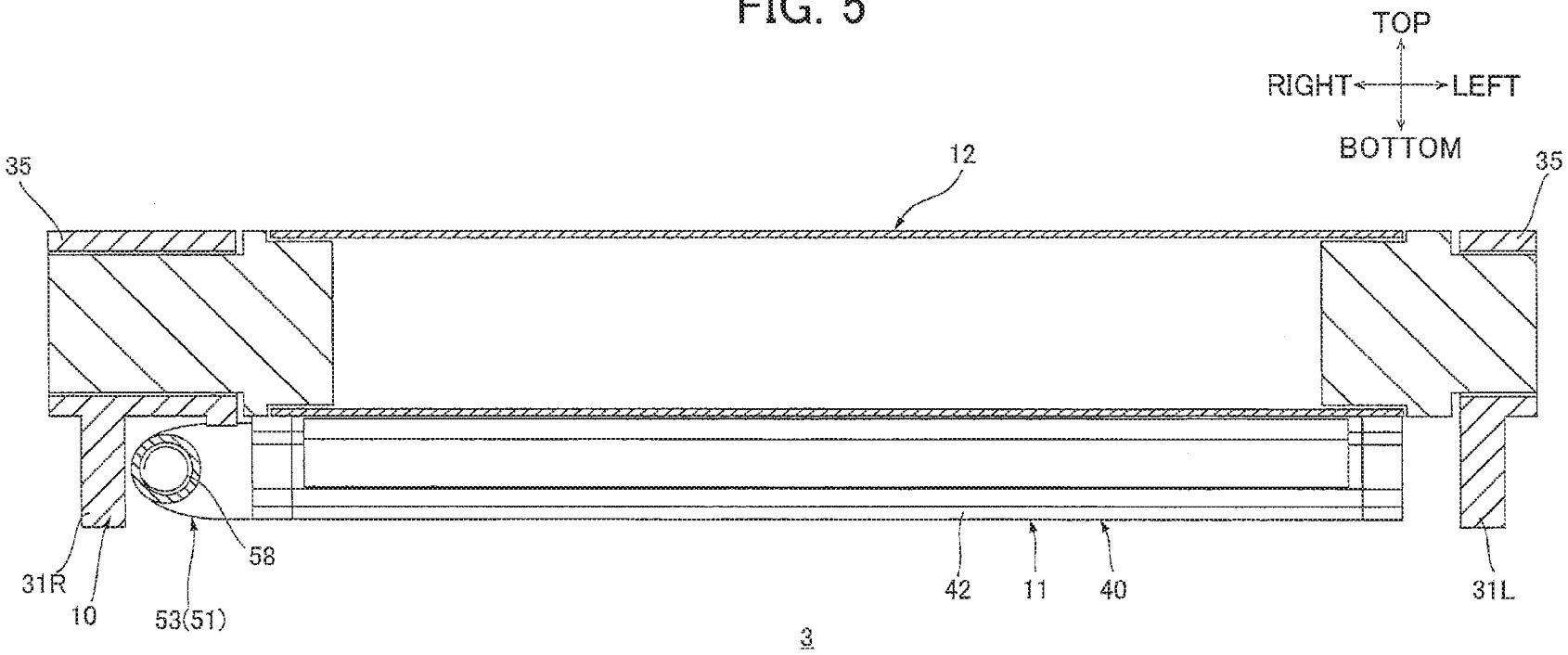
FIG. 5 is a cross-sectional view of the process cartridge taken along a line C-C in FIG. 3A.

As shown in FIGS. 3A, 3B, and 5, the drum unit 10 includes a left side plate 31L, a right side plate 31R, a drum cleaner 32, and a handle 33.

The left side plate 31L is positioned at a left end portion of the drum unit 10. The left side plate 31L extends both in the vertical direction and in the front-rear direction. The left side plate 31L includes a support part 35.

The support part 35 is positioned at an upper end portion of the left side plate 31L. The support part 35 has a cylindrical shape that extends in the left-right direction. A left end portion of the photosensitive drum 12 is rotatably fitted into the support part 35.

The right side plate 31R is positioned at a right end portion of the drum unit 10. The right side plate 31R has a configuration the same as that of the left side plate 31L. A right end portion of the photosensitive drum 12 is rotatably fitted into the support part 35 of the right side plate 31R.

Figure 6:
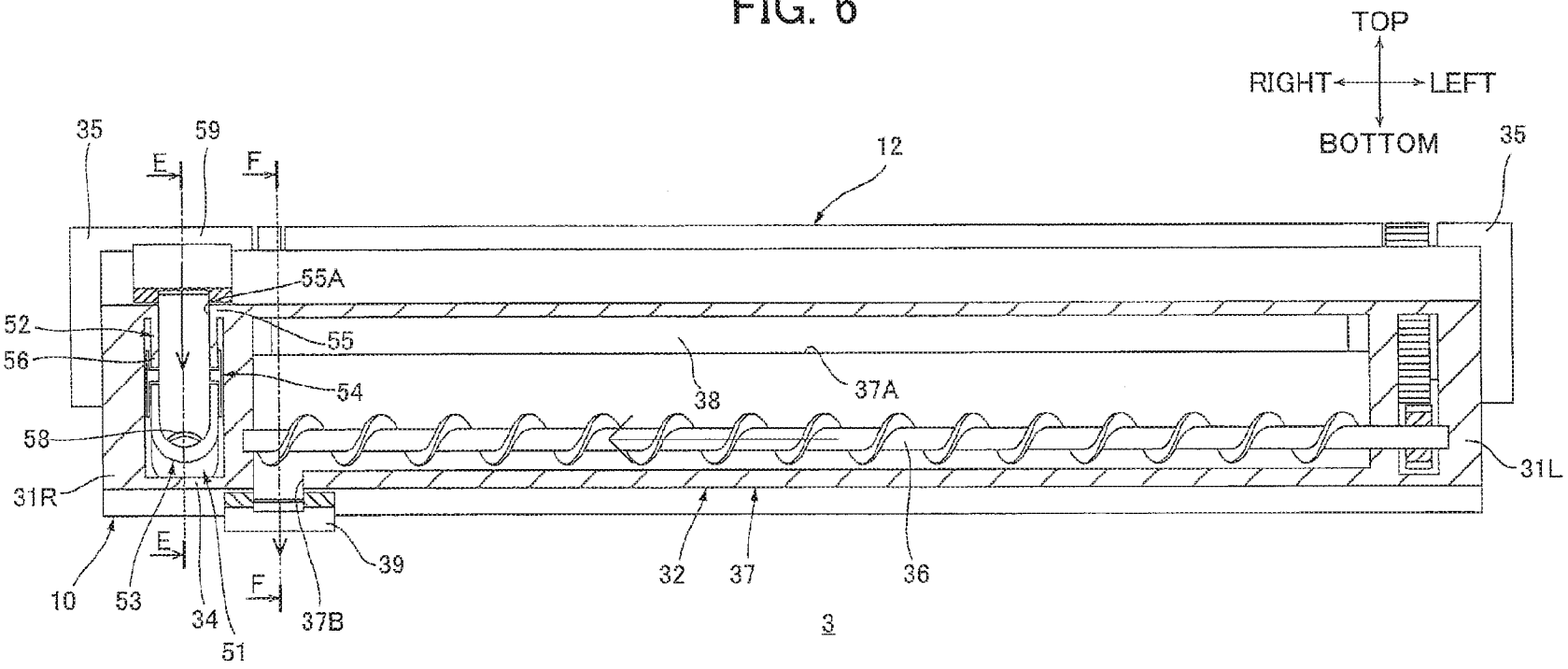
FIG. 6 is a cross-sectional view of the process cartridge taken along a line D-D in FIG. 3A.
Figure 7:
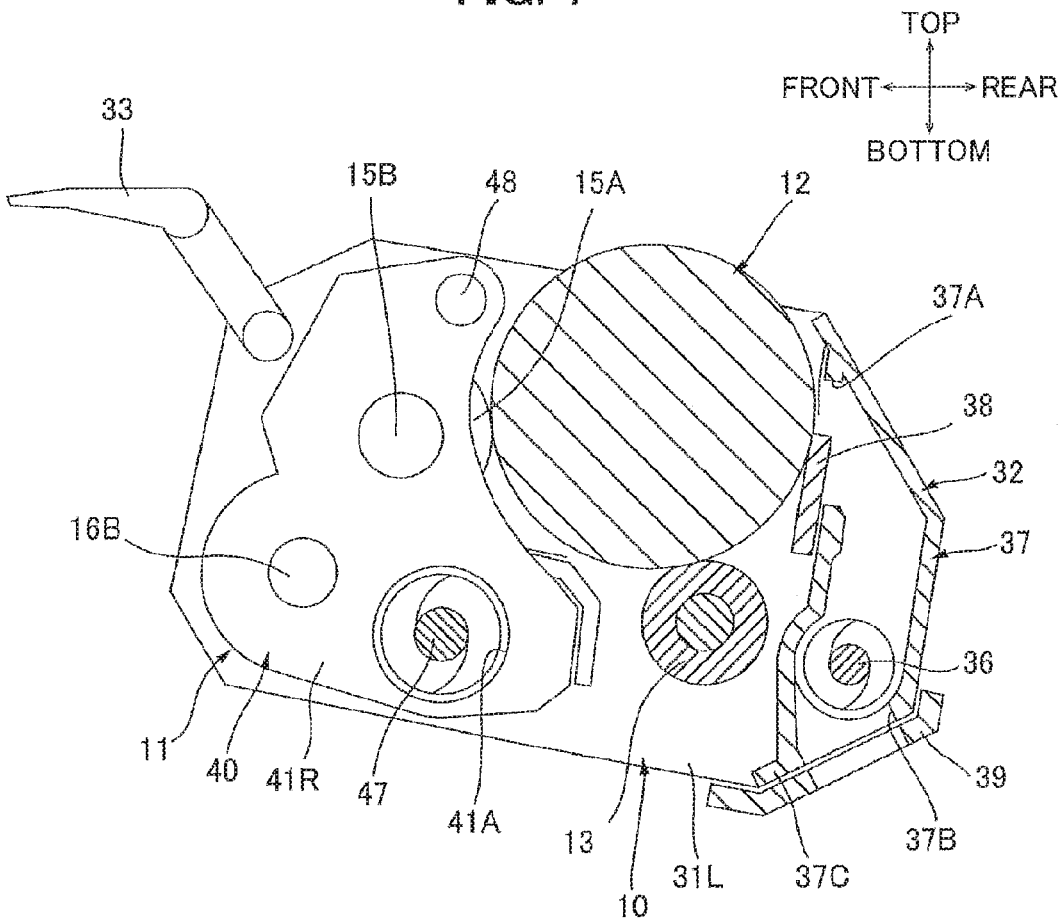
FIG. 7 is a cross-sectional view of the process cartridge taken along a line F-F in FIG. 6.

As shown in FIGS. 6 and 7, the drum cleaner 32 is positioned rearward of the photosensitive drum 12 and the charging roller 13. The drum cleaner 32 is positioned between the left side plate 31L and the right side plate 31R. The drum cleaner 32 is spaced apart from the right side plate 31R. A left end portion of the drum cleaner 32 is connected to the left side plate 31L, while a right end portion of the drum cleaner 32 is connected to the right side plate 31R through a connecting wall 34 at a lower end portion thereof. The drum cleaner 32 includes an accommodation part 37 having an opening 37A and an opening 37B; a blade 38; an auger screw 36; and a seal 39.

The accommodation part 37 has a flattened box shape and is elongated both in the vertical direction and in the left-right direction. The accommodation part 37 has a lower wall 37C that slopes rearward toward a top side thereof.

The opening 37A is positioned at an upper end portion of the accommodation part 37. The opening 37A penetrates a front wall of the accommodation part 37 in the front-rear direction. The opening 37A faces a rear portion of a circumferential surface of the photosensitive drum 12.

The opening 37B is positioned at a lower-right end portion of the accommodation part 37. The opening 37B penetrates the lower wall 37C of the accommodation part 37.

The blade 38 is positioned at an upper end portion of the drum cleaner 32. The blade 38 has a plate shape that is elongated both in the vertical direction and in the left-right direction. The blade 38 is attached to a front surface of the accommodation part 37 on a lower edge portion of the opening 37A. An upper end portion of the blade 38 is positioned within the opening 37A and in contact with the rear portion of the circumferential surface of the photosensitive drum 12.

The auger screw 36 is positioned at a lower end portion of the accommodation part 37. The auger screw 36 extends in the left-right direction.

The seal 39 is attached to a lower-rear surface of the lower wall 37C of the accommodation part 37 on an edge portion of the opening 37B. The seal 39 has a rectangular frame-like shape. The seal 39 surrounds the opening 37B. The seal 39 is formed of a sponge, for example.

As shown in FIG. 3A, the handle 33 is positioned at an upper-front end portion of the drum unit 10. The handle 33 is pivotally movable between an upright position (indicated by dashed lines in FIG. 3A) extending vertically upward, and an inclined position (indicated by solid lines in FIG. 3A) inclined forward from the upright position.

(2) Developing Unit

Figure 4:
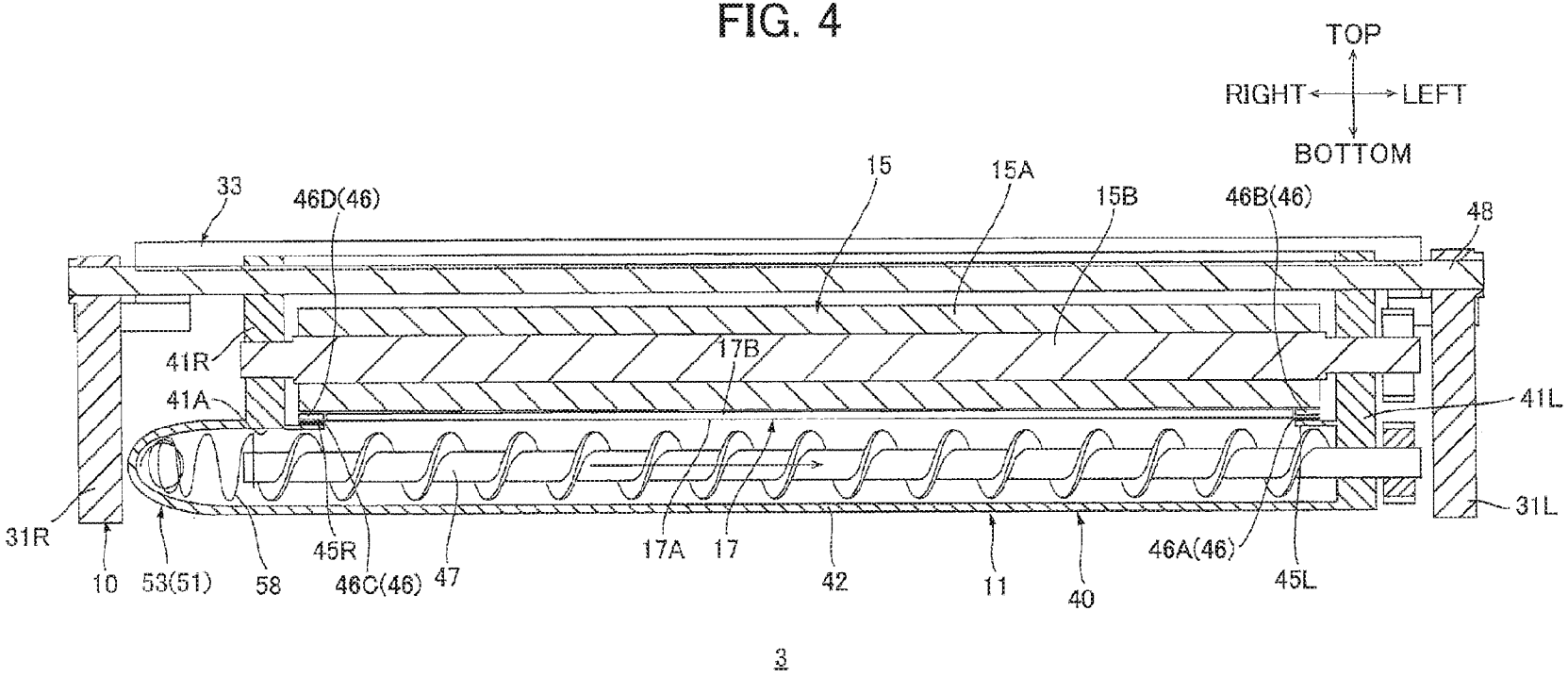
FIG. 4 is a cross-sectional view of the process cartridge taken along a line B-B in FIG. 3A.

As shown in FIGS. 3A and 4, the developing unit 11 is positioned between the left side plate 31L and the right side plate 31R. The developing unit 11 is pivotally movable about a support shaft 48 (described later) between a contact position (FIG. 8A) in which the developing roller 15 is in contact with the photosensitive drum 12, and a separated position (FIG. 8B) in which the developing roller 15 is separated from the photosensitive drum 12.

The following description of the developing unit 11 will be based on the developing unit 11 being in its contact position.

The developing unit 11 includes a frame 40, the developing roller 15, the supply roller 16, the blade 17, an auger screw 47, a plurality of seals 46, and the support shaft 48.

(2-1) Frame

The frame 40 has a box shape with an upper-rear opening. The frame 40 includes a left side wall 41L, a right side wall 41R having an opening 41A, a lower wall 42, a front wall 43, and a rear wall 44.

The left side wall 41L is positioned at a left end portion of the developing unit 11. The left side wall 41L is positioned rightward of the left side plate 31L and spaced apart from the left side plate 31L. The left side wall 41L extends both in the vertical direction and in the front-rear direction. The left side wall 41L includes a support part 45L.

The support part 45L is positioned between a left end portion of the auger screw 47 and a left end portion of the developing roller 15. The support part 45L protrudes rightward from a right surface of the left side wall 41L. The support part 45L has a plate shape that extends in the left-right direction.

The right side wall 41R is positioned at a right end portion of the developing unit 11. The right side wall 41R is positioned leftward of the right side plate 31R and spaced apart from the right side plate 31R. The right side wall 41R extends both in the vertical direction and in the front-rear direction. The right side wall 41R includes a support part 45R.

The opening 41A is positioned at a lower-rear end portion of the right side wall 41R. The opening 41A penetrates the right side wall 41R in the left-right direction. The opening 41A has a circular shape in a side view.

The support part 45R is positioned between a right end portion of the auger screw 47 and a right end portion of the developing roller 15. The support part 45R protrudes leftward from a left surface of the right side wall 41R. The support part 45R has a plate shape that extends in the left-right direction.

The lower wall 42 constitutes a lower wall of the developing unit 11. The lower wall 42 is positioned between the left side wall 41L and the right side wall 41R. The lower wall 42 extends both in the left-right direction and in the front-rear direction. A left edge of the lower wall 42 is connected to a lower edge of the left side wall 41L, while a right edge of the lower wall 42 is connected to a lower edge of the right side wall 41R.

The front wall 43 constitutes a front wall of the developing unit 11. The front wall 43 extends upward from a front edge of the lower wall 42. A left edge of the front wall 43 is connected to a front edge of the left side wall 41L, while a right edge of the front wall 43 is connected to a front edge of the right side wall 41R.

The rear wall 44 constitutes a rear wall of the developing unit 11. The rear wall 44 extends upward from a rear edge of the lower wall 42. A left edge of the rear wall 44 is connected to a rear edge of the left side wall 41L, while a right edge of the rear wall 44 is connected to a rear edge of the right side wall 41R.

(2-2) Developing Roller

The developing roller 15 includes the roller portion 15A and a shaft 15B.

The roller portion 15A constitutes an outer circumferential portion of the developing roller 15 in a radial direction of the developing roller 15. The roller portion 15A extends in the left-right direction. The roller portion 15A has a cylindrical shape.

The shaft 15B constitutes a center portion of the developing roller 15 in the radial direction of the developing roller 15. The shaft 15B extends in the left-right direction. The shaft 15B has a columnar shape. The shaft 15B is inserted into an interior of the roller portion 15A such that an outer circumferential surface of the shaft 15B is in contact with an inner circumferential surface of the roller portion 15A. A left end portion of the shaft 15B protrudes further leftward than a left end face of the roller portion 15A and is rotatably supported at the left side wall 41L. Similarly, a right end portion of the shaft 15B protrudes further rightward than a right end face of the roller portion 15A and is rotatably supported at the right side wall 41R.

(2-3) Supply Roller

The supply roller 16 includes a roller portion 16A and a shaft 16B.

The roller portion 16A constitutes an outer circumferential portion of the supply roller 16 in a radial direction of the supply roller 16. The roller portion 16A extends in the left-right direction. The roller portion 16A has a cylindrical shape. The roller portion 16A is in contact with a lower-front end portion of the roller portion 15A.

The shaft 16B constitutes a center portion of the supply roller 16 in the radial direction of the supply roller 16. The shaft 16B extends in the left-right direction. The shaft 16B has a columnar shape. The shaft 16B is inserted into an interior of the roller portion 16A such that an outer circumferential surface of the shaft 16B is in contact with an inner circumferential surface of the roller portion 16A. A left end portion of the shaft 16B protrudes further leftward than a left end face of the roller portion 16A and is rotatably supported at the left side wall 41L. Similarly, a right end portion of the shaft 16B protrudes further rightward than a right end face of the roller portion 16A and is rotatably supported at the right side wall 41R.

(2-4) Blade

The blade 17 includes a support plate 17A and a contact part 17B.

The support plate 17A has a plate shape that is elongated both in the front-rear direction and in the left-right direction. The support plate 17A is formed of metal, for example. A rear end portion of the support plate 17A is supported at an upper end portion of the rear wall 44.

The contact part 17B is supported on an upper surface of the support plate 17A at a front end portion thereof. The contact part 17B has a plate shape that is elongated in the left-right direction. The contact part 17B is formed of rubber, for example. The contact part 17B is in contact with a lower portion of an outer circumferential surface of the developing roller 15.

(2-5) Auger Screw

The auger screw 47 is positioned rearward of the supply roller 16 and downward of the developing roller 15. The auger screw 47 extends in the left-right direction.

(2-6) Seal

The plurality of seals 46 includes a seal 46A that seals a gap between a left end of the support plate 17A and the support part 45L; a seal 46B that seals a gap between the left end of the support plate 17A and a left end portion of the roller portion 15A; a seal 46C that seals a gap between a right end of the support plate 17A and the support part 45R; and a seal 46D that seals a gap between the right end of the support plate 17A and a right end portion of the roller portion 15A. The seals 46 each have a plate shape that extends in the left-right direction. The seals 46 are formed of a sponge, for example.

(2-7) Support Shaft

The support shaft 48 is positioned at an upper end portion of the developing unit 11. The support shaft 48 has a columnar shape that extends in the left-right direction. The support shaft 48 extends through the upper end portion of the developing unit 11. A left end portion of the support shaft 48 protrudes further leftward than the left side wall 41L and is rotatably supported at an upper end portion of the left side plate 31L. Similarly, a right end portion of the support shaft 48 protrudes further rightward than the right side wall 41R and is rotatably supported at an upper end portion of the right side plate 31R.

(3) Second Toner Conveying Part

As shown in FIGS. 6 and 8A, the second toner conveying part 51 is positioned at a right end portion of the process cartridge 3. The second toner conveying part 51 is positioned between the right side plate 31R and the drum cleaner 32, and is also positioned between the right side plate 31R and the developing unit 11. The second toner conveying part 51 includes a third toner conveying part 52, a fourth toner conveying part 53, a connecting member 54, and a screw 58.

The third toner conveying part 52 is positioned rearward of the photosensitive drum 12. The third toner conveying part 52 is positioned between the right side plate 31R and the drum cleaner 32. The third toner conveying part 52 is supported at the drum unit 10. The third toner conveying part 52 includes a wall part 55 having a second opening 55A, a tubular part 56, and a seal 59.

The wall part 55 is positioned between an upper-rear end portion of the right side plate 31R and an upper-rear end portion of the drum cleaner 32. The wall part 55 has a plate shape that extends in the left-right direction. A right edge of the wall part 55 is connected to a left surface of the right side plate 31R. A left edge of the wall part 55 is connected to a right surface of the drum cleaner 32. The wall part 55 slopes forward toward a top side thereof.

The second opening 55A is positioned at a center portion of the wall part 55 in the left-right direction. The second opening 55A is positioned opposite the developing roller 15 with respect to the photosensitive drum 12 in the front-rear direction. That is, the second opening 55A is positioned rearward of the photosensitive drum 12. Further, the second opening 55A is positioned further rightward than the developing roller 15 (FIG. 4). Further, the second opening 55A is positioned further rightward than a corresponding discharge opening 106A (described later) (FIG. 2). The second opening 55A penetrates the wall part 55.

The tubular part 56 is positioned downward of the wall part 55. The tubular part 56 extends downward from an edge of the second opening 55A on a lower-front surface of the wall part 55.

The seal 59 is attached to an upper-rear surface of the wall part 55 on an edge portion of the second opening 55A. The seal 59 has a rectangular frame-like shape. The seal 59 surrounds the second opening 55A. The seal 59 is formed of a sponge, for example.

As shown in FIGS. 4 and 8A, the fourth toner conveying part 53 is positioned downward of the photosensitive drum 12. The fourth toner conveying part 53 extends in the front-rear direction. The fourth toner conveying part 53 is positioned rightward of the charging roller 13 (FIG. 3A). That is, the fourth toner conveying part 53 overlaps the charging roller 13 when viewed in the left-right direction. The fourth toner conveying part 53 is supported at the developing unit 11. A front end portion of the fourth toner conveying part 53 is connected to a lower-rear end portion of the right side wall 41R and is in communication with the opening 41A. A rear end portion of the fourth toner conveying part 53 is positioned downward of the third toner conveying part 52. The rear end portion of the fourth toner conveying part 53 is bent upward to extend upward, and faces a lower end portion of the tubular part 56. A portion of the fourth toner conveying part 53 that extends in the front-rear direction constitutes a second portion of the second toner conveying part 51.

The screw 58 is positioned inside the fourth toner conveying part 53. The screw 58 is a coil formed of metal, for example. A front end portion of the screw 58 is connected to a right end portion of the auger screw 47.

As shown in FIGS. 6 and 8A, the connecting member 54 is provided to surround a lower end portion of the third toner conveying part 52 and a rear end portion of the fourth toner conveying part 53. The connecting member 54 is formed of an elastic material such as sponge or rubber, for example. The connecting member 54 has a cylindrical shape. The lower end portion of the third toner conveying part 52 is inserted into an upper end portion of the connecting member 54. The rear end portion of the fourth toner conveying part 53 is inserted into a lower end portion of the connecting member 54. With this arrangement, the connecting member 54 connects the fourth toner conveying part 53 to the third toner conveying part 52 such that the fourth toner conveying part 53 is movable relative to the third toner conveying part 52. The tubular part 56 of the third toner conveying part 52, a portion of the rear end portion of the fourth toner conveying part 53 that extends upward, and the connecting member 54 constitute a first portion of the second toner conveying part 51.

3. Main Casing

Figure 10:
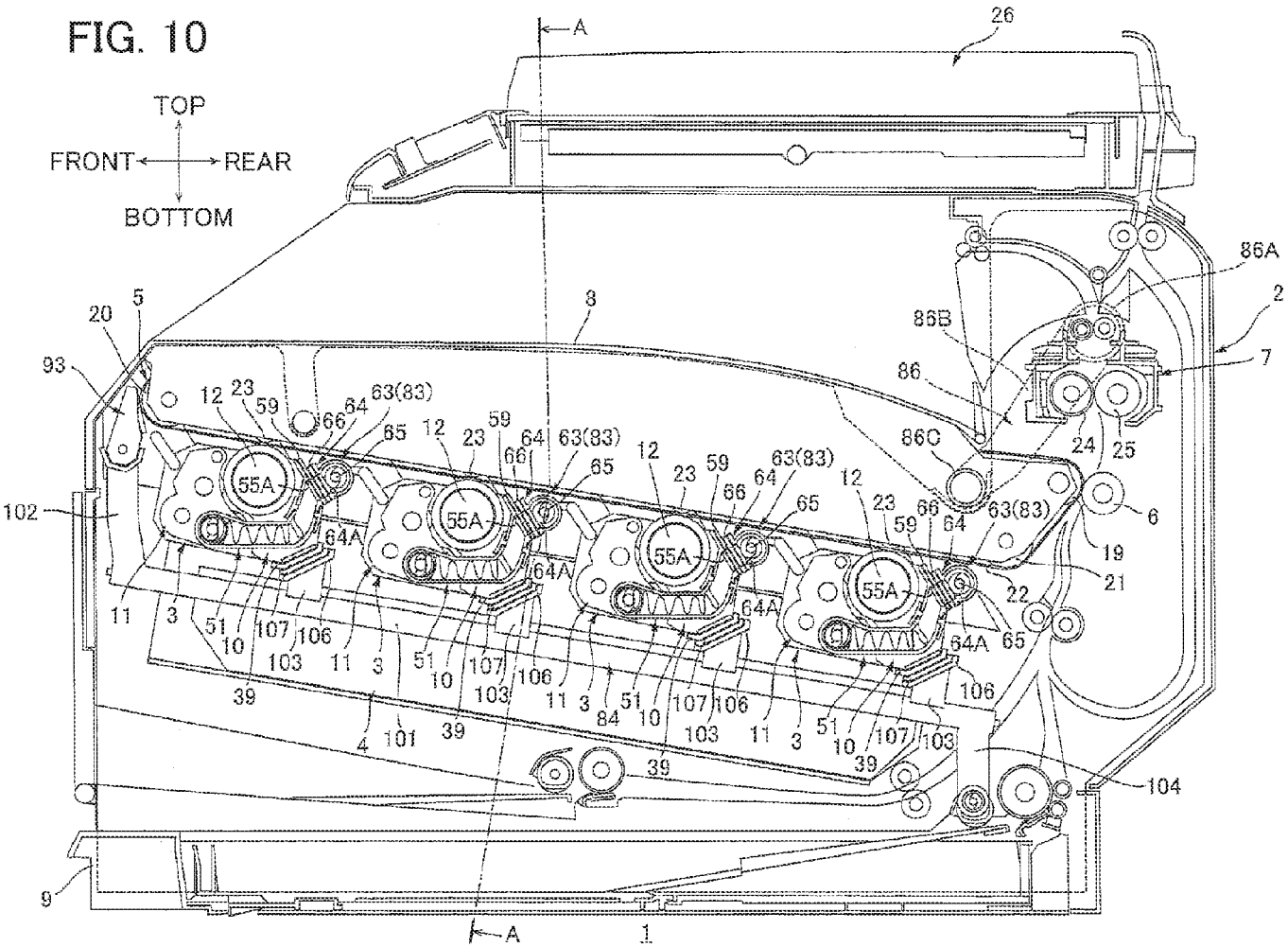
FIG. 10 is a cross-sectional view of the image forming apparatus taken along a line H-H in FIG. 2.

As shown in FIGS. 2 and 10, the main casing 2 includes a casing 80 having an opening 80A; a frame 81; a plurality of (four) support parts 82; a plurality of (four) main-casing toner conveying parts 83; a belt cleaner 93; a toner discharge part 84; an accommodation part 85; and the pivot member 86.

(1) Casing and Frame

As shown in FIG. 2, the casing 80 constitutes an exterior of the main casing 2. The casing 80 has a box shape. The casing 80 is formed of resin, for example. The casing 80 includes a side cover 87.

The opening 80A is positioned at an upper-right end portion of the casing 80. The opening 80A is positioned rightward of the support parts 82. The opening 80A penetrates a right wall of the casing 80 in the left-right direction.

The side cover 87 is positioned at the upper-right end portion of the casing 80. The side cover 87 has a plate shape that extends in the vertical direction. The side cover 87 is pivotally movable about a lower end thereof between an open position (indicated by dashed lines in FIG. 2) that opens the opening 80A and a closed position (indicated by solid lines in FIG. 2) that closes the opening 80A.

The frame 81 is disposed inside the casing 80. The frame 81 is formed of metal, such as stainless steel or steel, for example. The frame 81 includes a left side plate 71L; a right side plate 71R having a plurality of (four) insertion holes 71A and an insertion hole 71B (FIG. 9); a lower plate 72, a left positioning plate 73L having a plurality of (four) recessed parts 73A; and a right positioning plate 73R having a plurality of (four) recessed parts 73A.

The left side plate 71L is positioned inside the casing 80 and at a left end portion of the casing 80. The left side plate 71L is elongated both in the vertical direction and in the front-rear direction. The left side plate 71L includes a plurality of (four) main-casing guide parts 74 (FIG. 12).

As shown in FIG. 12, the main-casing guide parts 74 are positioned on an inner surface (right surface) of the left side plate 71L. The main-casing guide parts 74 have a U-shape in a side view with a top opening. The main-casing guide parts 74 extend in a direction from upper front to lower rear. That is, each of the main-casing guide parts 74 slopes forward toward a top side thereof. Each main-casing guide part 74 receives the support part 35 of the left side plate 31L. The main-casing guide part 74 guides the support part 35 of the left side plate 31L into the recessed part 73A of the left positioning plate 73L. With this configuration, the main-casing guide parts 74 guide the process cartridges 3 when the process cartridges 3 are mounted in and removed from the main casing 2. The four main-casing guide parts 74 are arrayed at intervals in the front-rear direction.

The right side plate 71R is positioned inside the casing 80 and at a right end portion of the casing 80. The right side plate 71R is positioned rightward of the left side plate 71L and spaced apart from the left side plate 71L. The right side plate 71R has the same shape as the left side plate 71L, except that the insertion holes 71A and the insertion holes 71B are formed. Each main-casing guide part 74 of the right side plate 71R receives the support part 35 of the right side plate 31R. The main-casing guide part 74 of the right side plate 71R guides the support part 35 of the right side plate 31R into the recessed part 73A of the right positioning plate 73R.

As shown in FIGS. 2 and 9, the insertion holes 71A are positioned diagonally upward and rearward of the corresponding process cartridges 3 when viewed in the left-right direction. The plurality of insertion holes 71A are arrayed at intervals in the front-rear direction. The insertion holes 71A penetrate the right side plate 71R in the left-right direction. The insertion holes 71A have a circular shape in a side view.

As shown in FIG. 9, the insertion hole 71B is positioned at a lower-rear end portion of the right side plate 71R. The insertion hole 71B penetrates the right side plate 71R in the left-right direction. The insertion hole 71B has a circular shape in a side view.

As shown in FIG. 2, the lower plate 72 is positioned downward of the scanning unit 4. The lower plate 72 extends in the left-right direction. A left edge of the lower plate 72 is connected to the left side plate 71L. A right edge of the lower plate 72 is connected to the right side plate 71R.

The left positioning plate 73L is positioned between the left side plate 71L and the scanning unit 4. The left positioning plate 73L is elongated both in the vertical direction and in the front-rear direction. A lower end portion of the left positioning plate 73L is bent leftward and connected to the lower plate 72.

As shown in FIGS. 2 and 12, the recessed parts 73A of the left positioning plate 73L are positioned at an upper end portion of the left positioning plate 73L. The recessed parts 73A are recessed downward from an upper edge of the left positioning plate 73L. The recessed parts 73A have a U-shape with a top opening. The four recessed parts 73A are arrayed at intervals in the front-rear direction.

The right positioning plate 73R is positioned between the right side plate 71R and the scanning unit 4. The right positioning plate 73R has the same shape as the left positioning plate 73L.

(2) Toner Cartridge, Support Part, and Main-Casing Toner Conveying Part

As shown in FIGS. 2 and 9, each of the toner cartridges 18 includes a first agitator 91, and a first toner conveying part 92 having a first opening 92A.

The first agitator 91 is positioned inside the toner cartridge 18 at its a lower-rear end portion. The first agitator 91 is configured to convey toner accommodated in the toner cartridge 18 toward the first toner conveying part 92.

The first toner conveying part 92 is positioned at a lower-front end portion of the toner cartridge 18. The first toner conveying part 92 extends downward from a front end portion of the toner cartridge 18. The first toner conveying part 92 has a square cylindrical shape. The first toner conveying part 92 includes a second agitator 92B.

The first opening 92A is formed on a rear wall of the first toner conveying part 92 at a lower end portion thereof. The first opening 92A penetrates the rear wall at the lower end portion of the first toner conveying part 92 in the front-rear direction.

The second agitator 92B is positioned inside the first toner conveying part 92 at the lower end portion thereof. The second agitator 92B is configured to convey toner in the first toner conveying part 92 toward the first opening 92A.

The plurality of support parts 82 is positioned diagonally upward and rightward of the plurality of process cartridges 3, respectively. Each support part 82 has an arcuate shape that conforms to a part of a lower wall of the toner cartridge 18.

The plurality of main-casing toner conveying parts 83 is positioned downward of the plurality of support parts 82, respectively. Each main-casing toner conveying part 83 connects the first toner conveying part 92 and the second toner conveying part 51. Each main-casing toner conveying part 83 includes a wall part 61 having an opening 61A, a first part 62, and a second part 63.

The wall part 61 is positioned downward of a front end portion of the support part 82. The wall part 61 extends in the vertical direction. An upper edge of the wall part 61 is connected to a front edge of the support part 82.

The opening 61A is formed on the wall part 61 at its lower end portion. The opening 61A penetrates the wall part 61 in the front-rear direction. The opening 61A can communicate with the first opening 92A of the toner cartridge 18.

The first part 62 is positioned rearward of the wall part 61. The first part 62 extends diagonally downward and rearward from a rear surface of the wall part 61 on an edge portion of the first opening 92A. The first part 62 has a square cylindrical shape.

As shown in FIGS. 2 and 10, the second part 63 extends leftward from a lower end portion of the first part 62. The second part 63 has a cylindrical shape. The second part 63 includes a wall 64 having a third opening 64A, and an auger screw 65.

The wall 64 is positioned at a left end portion of the second part 63 at a lower-front end portion thereof. The wall 64 slopes forward toward a top side thereof. The wall 64 has a plate shape that extends in the left-right direction. The wall 64 includes a seal 66.

The third opening 64A is positioned at a center portion of the wall 64. The third opening 64A penetrates the wall 64. The third opening 64A can communicate with the second opening 55A of the process cartridge 3.

The seal 66 is attached to a lower-front surface of the wall 64 on an edge portion of the third opening 64A. The seal 66 has a rectangular frame-like shape. The seal 66 surrounds the third opening 64A. The seal 66 is formed of a sponge, for example. The seal 66 contacts the seal 59 of the process cartridge 3.

The auger screw 65 is positioned inside the second part 63. The auger screw 65 extends in the left-right direction.

(3) Belt Cleaner, Toner Discharge Part, and Accommodation Part

Figure 11:
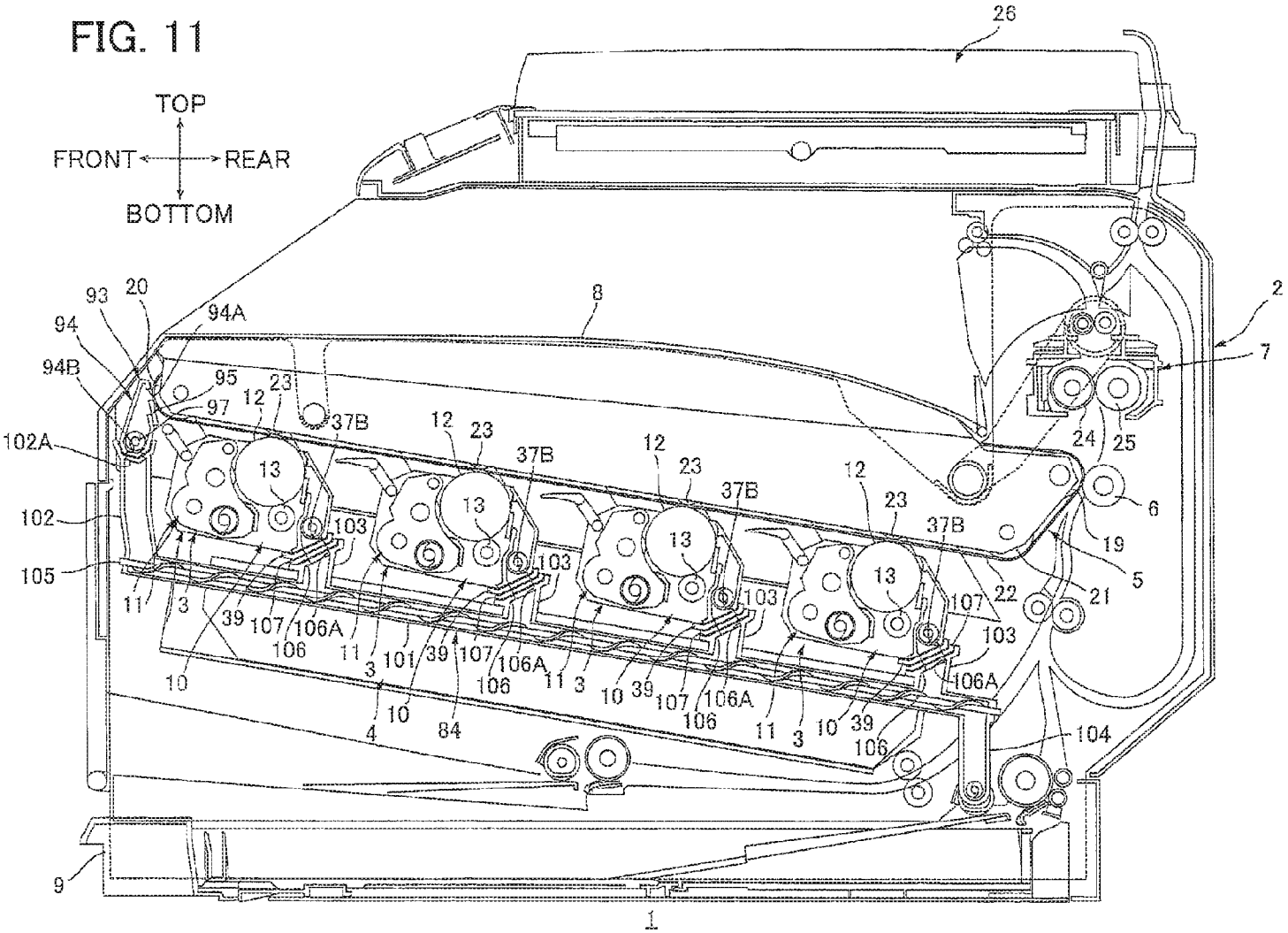
FIG. 11 is a cross-sectional view of the image forming apparatus taken along a line I-I in FIG. 2.

As shown in FIG. 11, the belt cleaner 93 is positioned at a front end portion of the belt unit 5. The belt cleaner 93 includes an accommodation part 94 having an opening 94A and an opening 94B; a blade 95; and an auger screw 97.

The accommodation part 94 has a box shape that is elongated in the left-right direction.

The opening 94A is positioned at an upper end portion of the accommodation part 94. The opening 94A penetrates a rear wall of the accommodation part 94 in the front-rear direction. The opening 94A faces the front end portion of the transfer belt 22.

The opening 94B is positioned at a right end portion of the accommodation part 94. The opening 94B penetrates a lower wall of the accommodation part 94 in the vertical direction.

The blade 95 is positioned at an upper end portion of the belt cleaner 93. The blade 95 has a plate shape that is elongated both in the vertical direction and in the left-right direction. The blade 95 is attached to a rear surface of the accommodation part 94 on a lower edge of the opening 94A. An upper edge of the blade 95 is positioned within the opening 94A and contacts a front portion of an outer surface of the transfer belt 22.

The auger screw 97 is positioned inside the accommodation part 94 at a lower end portion thereof. The auger screw 97 extends in the left-right direction.

As shown in FIGS. 2 and 11, the toner discharge part 84 is positioned between the right positioning plate 73R and the scanning unit 4. The toner discharge part 84 includes a main part 101; an auger screw 105; a connecting part 102 having an opening 102A; a plurality of (four) connecting parts 103; and a connecting part 104.

The main part 101 is positioned between right end portions of the process cartridges 3 and the lower plate 72. The main part 101 is elongated in the front-rear direction. The main part 101 has a cylindrical shape.

The auger screw 105 is positioned inside the main part 101. The auger screw 105 extends in the front-rear direction.

The connecting part 102 is connected to the belt cleaner 93. The connecting part 102 extends upward from a front end portion of the main part 101. The connecting part 102 has a cylindrical shape. An upper wall of the connecting part 102 has an arcuate shape that conforms to a shape of a lower wall of the belt cleaner 93.

The opening 102A is positioned at an upper end portion of the connecting part 102. The opening 102A penetrates the upper wall of the connecting part 102 in the vertical direction. The opening 102A can communicate with the opening 94B of the belt cleaner 93.

The connecting parts 103 are connected to the process cartridges 3, respectively. The plurality of connecting parts 103 is positioned rearward of the connecting part 102. The plurality of connecting parts 103 is arrayed at intervals in the front-rear direction. The plurality of connecting parts 103 extends upward from an upper portion of a circumferential wall of the main part 101. Each connecting part 103 has a cylindrical shape. The connecting part 103 includes a wall part 106 having the discharge opening 106A.

The wall part 106 is positioned at an upper end portion of the connecting part 103. The wall part 106 slopes rearward toward a top side thereof. The wall part 106 has a plate shape that extends in the left-right direction. The wall part 106 includes a seal 107.

The discharge opening 106A is positioned at a center portion of the wall part 106. The discharge opening 106A penetrates the wall part 106. The discharge opening 106A can communicate with the opening 37B of the process cartridge 3.

The seal 107 is attached to an upper-front surface of the wall part 106 on an edge portion of the discharge opening 106A. The seal 107 has a rectangular frame-like shape. The seal 107 surrounds the discharge opening 106A. The seal 107 is formed of a sponge, for example. The seal 107 contacts the seal 39 of the process cartridge 3.

As shown in FIGS. 9 and 11, the connecting part 104 is connected to the accommodation part 85. The connecting part 104 extends downward from a rear end portion of the main part 101, and is bent rightward at its lower end portion to extend rightward. A right end portion of the connecting part 104 protrudes further rightward than the right side plate 71R through the insertion hole 71B formed in the right side plate 71R. The connecting part 104 has a cylindrical shape.

As shown in FIGS. 2 and 9, the accommodation part 85 is positioned between a lower end portion of the right side plate 71R and a lower end portion of a right wall of the casing 80. The accommodation part 85 has a box shape that is elongated in the front-rear direction. An upper-rear end portion of the accommodation part 85 is in communication with the right end portion of the connecting part 104.

(4) Pivot Member

As shown in FIGS. 9 and 12, the pivot member 86 is positioned at an upper-rear end portion of the main casing 2. The pivot member 86 is fixed to a rear end portion of the belt unit 5, and is pivotally movably supported at an upper-rear end portion of the left side plate 71L and an upper-rear end portion of the right side plate 71R. The pivot member 86 includes a pair of shaft parts 86A, a pair of arms 86B, and a support shaft 86C.

One of the shaft parts 86A is disposed at a left end portion of the pivot member 86, while the other of the shaft parts 86A is disposed at a right end portion of the pivot member 86. The pair of shaft parts 86A overlaps the fixing unit 7 when viewed in the left-right direction. The left shaft part 86A is pivotally movably supported at the upper-rear end portion of the left side plate 71L. The right shaft part 86A is pivotally movably supported at the upper-rear end portion of the right side plate 71R. The shaft parts 86A have a cylindrical shape that extends in the left-right direction.

One of the arms 86B is disposed at the left end portion of the pivot member 86, while the other of the arms 86B is disposed at a right end portion of the pivot member 86. The left arm 86B is positioned leftward of the left side plate 71L and extends diagonally forward and downward from a peripheral surface of the left shaft part 86A. The right arm 86B is positioned rightward of the right side plate 71R and extends diagonally forward and downward from a peripheral surface of the right shaft part 86A. The arms 86B have a plate shape.

The support shaft 86C has a columnar shape that extends in the left-right direction. The support shaft 86C extends through the rear end portion of the belt unit 5 in the left-right direction. A left end portion of the support shaft 86C is connected to a lower-front end portion of the left arm 86B, while a right end portion of the support shaft 86C is connected to a lower-front end portion of the right arm 86B.

The reading unit 26 is connected to the shaft parts 86A of the pivot member 86 through connecting parts (not shown). Accordingly, the cover 8, the belt unit 5, and the reading unit 26 are pivotally movable together about the axis of the shaft parts 86A of the pivot member 86.

4. Conveyance of Toner (1) Toner Supply to Developing Unit

As shown in FIG. 9, toner accommodated in the toner cartridge 18 is conveyed toward the first toner conveying part 92 as the first agitator 91 rotates. Then, toner conveyed into the first toner conveying part 92 is supplied to the first part 62 of the main-casing toner conveying part 83 through the first opening 92A and the opening 61A as the second agitator 92B rotates. Toner supplied into the first part 62 falls diagonally rearward and downward inside the first part 62 due to gravity.

Toner fallen diagonally rearward and downward inside the first part 62 is then conveyed leftward inside the second part 63 by the auger screw 65, as shown in FIG. 2.

Subsequently, toner conveyed leftward inside the second part 63 is supplied into the third toner conveying part 52 of the second toner conveying part 51 through the third opening 64A and the second opening 55A, as shown in FIGS. 8A and 10.

Then, toner supplied into the third toner conveying part 52 is supplied to the rear end portion of the fourth toner conveying part 53 through the connecting member 54 due to gravity, as shown in FIG. 8A. Toner supplied to the fourth toner conveying part 53 is then supplied into the frame 40 through the opening 41A by the screw 58.

Then, as shown in FIG. 4, toner supplied into the frame 40 is conveyed rightward by the auger screw 47. In this way, toner is supplied into the lower-rear end portion in the frame 40.

Thereafter, as shown in FIG. 3A, in the image-forming operation described above, the supply roller 16 supplies toner to the developing roller 15, and toner carried on the developing roller 15 is supplied onto an electrostatic latent image on the surface of the photosensitive drum 12.

(2) Collection of Waste Toner

In the above-described image-forming operation, the surface of the photosensitive drum 12 is cleaned by the drum cleaner 32 after a toner image on the surface of the photosensitive drum 12 is transferred onto the transfer belt 22.

At this time, as shown in FIGS. 6 and 7, waste toner remaining on the surface of the photosensitive drum 12 can be scraped off by the blade 38 of the drum cleaner 32, and is accommodated in the accommodation part 37.

The waste toner accommodated in the accommodation part 37 is conveyed rightward inside the accommodation part 37 by the auger screw 36.

Then, as shown in FIG. 11, the waste toner in the accommodation part 37 is supplied into the corresponding connecting part 103 of the toner discharge part 84 through the opening 37B and the discharge opening 106A.

The waste toner supplied into the connecting part 103 falls downward inside the connecting part 103 due to gravity to be supplied into the main part 101. The waste toner supplied into the main part 101 is conveyed rearward inside the main part 101 by the auger screw 105.

Thereafter, as shown in FIGS. 9 and 11, the waste toner is accommodated in the accommodation part 85 through the connecting part 104.

Further, in the above-described image-forming operation, waste toner remaining on the surface of the transfer belt 22 is also cleaned by the belt cleaner 93, and is accommodated in the accommodation part 85 sequentially through the connecting part 102, the main part 101, and the connecting part 104.

5. Mounting and Removing of Process Cartridge

Next, operations for mounting and removing the process cartridges 3 relative to the main casing 2 will be described.

When the process cartridges 3 have been mounted in the main casing 2 as shown in FIGS. 2 and 10, the seal 59 of each process cartridge 3 is in contact with the seal 66 of the corresponding main-casing toner conveying part 83. That is, the second opening 55A of the process cartridge 3 is in communication with the third opening 64A of the main-casing toner conveying part 83. In other words, the second opening 55A of the process cartridge 3 is in communication with the first opening 92A of the corresponding toner cartridge 18 through the main-casing toner conveying part 83. Further, the seal 39 of the process cartridge 3 is in contact with the seal 107 of the corresponding connecting part 103 of the toner discharge part 84. That is, communication between the opening 37B of the process cartridge 3 and the discharge opening 106A of the toner discharge part 84 is provided.

At this time, the process cartridge 3 is in its first position.

To remove any of the process cartridges 3 from the main casing 2, a user first pivotally moves the process cartridge 3 clockwise in a right side view about a rotational axis of the photosensitive drum 12, as shown in FIG. 12.

Through this movement, the seal 59 of the process cartridge 3 is separated from the seal 66 of the corresponding main-casing toner conveying part 83 while moving rearward and downward. Accordingly, communication between the second opening 55A of the process cartridge 3 and the third opening 64A of the main-casing toner conveying part 83 is interrupted. That is, communication between the second opening 55A of the process cartridge 3 and the first opening 92A of the corresponding toner cartridge 18 is interrupted. Further, the seal 39 of the process cartridge 3 is separated forward from the seal 107 of the corresponding connecting part 103 of the toner discharge part 84. Accordingly, communication between the opening 37B of the process cartridge 3 and the discharge opening 106A of the toner discharge part 84 is interrupted.

At this time, the process cartridge 3 is in its second position.

Then, the user pulls the process cartridge 3 diagonally upward and forward from the main casing 2. The process cartridge 3 is moved diagonally upward and forward along the main-casing guide parts 74, and separated from the main casing 2 through the opening 2A.

Through this operation, the process cartridge 3 can be completely removed from the main casing 2.

To mount the process cartridge 3 in the main casing 2, the user mounts the process cartridge 3 in the main casing 2 by performing the operation to remove the process cartridge 3 from the main casing 2 described above in reverse.

That is, the user inserts the process cartridge 3 into the main casing 2 through the opening 2A. Then, the process cartridge 3 moves diagonally rearward and downward along the main-casing guide parts 74. With this movement, the support parts 35 of the process cartridge 3 are fitted into the recessed parts 73A of the left positioning plate 73L and the right positioning plate 73R.

Next, the user pivotally moves the process cartridge 3 counterclockwise in a right side view about the rotational axis of the photosensitive drum 12.

Then, as shown in FIG. 10, the seal 59 of the process cartridge 3 contacts the seal 66 of the corresponding main-casing toner conveying part 83, and the seal 39 of the process cartridge 3 contacts the seal 107 of the corresponding connecting part 103 of the toner discharge part 84.

Through this operation, the process cartridge 3 can be completely mounted in the main casing 2.

6. Operational Advantages (1) According to the image forming apparatus 1, as shown in FIGS. 2 and 9, the main-casing toner conveying part 83 that supplies toner accommodated in the toner cartridge 18 to the process cartridge 3 is disposed diagonally upward and rearward of the process cartridge 3.

Further, as shown in FIG. 8A, the process cartridge 3 has the second opening 55A that communicates with the third opening 64A of the main-casing toner conveying part 83. The second opening 55A is positioned opposite the developing unit 11 relative to the photosensitive drum 12. That is, the second opening 55A is positioned at the rear end portion of the process cartridge 3.

Accordingly, as shown in FIG. 12, in a state where the opening 2A is exposed, the process cartridge 3 can be mounted in and removed from the main casing 2 so as to pass forward of the main-casing toner conveying part 83 without interfering with the main-casing toner conveying part 83, by manipulating the process cartridge 3 from a front side of the main casing 2.

As a result, the process cartridge 3 can be smoothly mounted in and removed from the main casing 2 from an upper-front side thereof despite the configuration in which the toner cartridge 18 is positioned further upward than the process cartridge 3.

Further, according to the image forming apparatus 1, as shown in FIG. 12, the shaft parts 86A are disposed at positions overlapping the fixing unit 7 when viewed in the left-right direction, and the cover 8 and the belt unit 5 are integrally pivotally moved upward about the axis of the shaft parts 86A of the pivot member 86 to open the opening 2A.

Accordingly, the opening 2A can be exposed through one action, and thus, the process cartridge 3 can be more smoothly mounted in and removed from the main casing 2.

(2) According to the image forming apparatus 1, as shown in FIG. 8A, the fourth toner conveying part 53 of the second toner conveying part 51 is disposed downward of the photosensitive drum 12.

Accordingly, the fourth toner conveying part 53 can be efficiently disposed by using a space downward of the photosensitive drum 12.

(3) According to the image forming apparatus 1, as shown in FIGS. 3A and 8A, the fourth toner conveying part 53 of the second toner conveying part 51 overlaps the charging roller 13 when viewed in the left-right direction.

Accordingly, the fourth toner conveying part 53 can be efficiently disposed by using a space rightward of the charging roller 13.

(4) According to the image forming apparatus 1, as shown in FIGS. 4 and 8A, the second opening 55A of the second toner conveying part 51 is positioned further rightward than the developing roller 15.

Accordingly, toner can be supplied to the process cartridge 3 at a position outward of the developing roller 15 in the left-right direction.

Figure 8B:
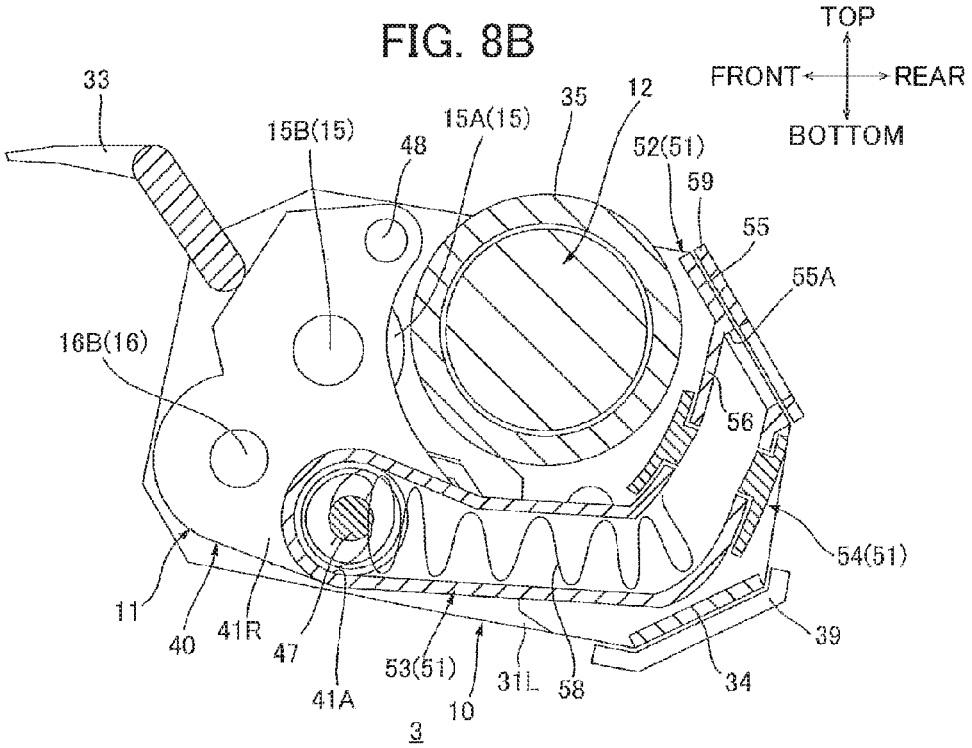
FIG. 8B is a cross-sectional view of the process cartridge taken along the line E-E in FIG. 6, showing a separated position of a developing unit shown in FIG. 8A.

(5) According to the image forming apparatus 1, as shown in FIGS. 8A and 8B, the developing unit 11 is pivotally movable relative to the drum unit 10 between the contact position and the separated position. Further, the second toner conveying part 51 includes the third toner conveying part 52 that has the second opening 55A and is supported at the drum unit 10, and the fourth toner conveying part 53 that is connected to the developing unit 11 and is movable relative to the third toner conveying part 52.

Accordingly, in a state where the second toner conveying part 51 is connected to the developing unit 11, the developing unit 11 can move between the contact position and the separated position.

(6) According to the image forming apparatus 1, as shown in FIGS. 8A and 8B, the second toner conveying part 51 includes the connecting member 54 that connects the third toner conveying part 52 and the fourth toner conveying part 53.

Accordingly, the third toner conveying part 52 and the fourth toner conveying part 53 can be reliably connected to each other by the connecting member 54.

As a result, toner can be reliably conveyed inside the second toner conveying part 51.

(7) According to the image forming apparatus 1, the connecting member 54 is formed of a sponge.

Accordingly, as shown in FIGS. 8A and 8B, when the developing unit 11 moves between the contact position and the separated position, the connecting member 54 can be elastically deformable to follow the movement of the fourth toner conveying part 53 by the elasticity of the sponge.

As a result, the third toner conveying part 52 and the fourth toner conveying part 53 can be more reliably connected to each other by the connecting member 54.

(8) According to the image forming apparatus 1, as shown in FIGS. 10 and 12, the process cartridge 3 can pivotally move inside the casing 80 about the rotational axis of the photosensitive drum 12 between the first position providing communication between the third opening 64A of the main-casing toner conveying part 83 and the second opening 55A, and the second position interrupting communication between the third opening 64A of the main-casing toner conveying part 83 and the second opening 55A.

Accordingly, the process cartridge 3 can be removed from the main casing 2 after communication between the third opening 64A of the main-casing toner conveying part 83 and the second opening 55A is interrupted by placing the process cartridge 3 in the second position inside the main casing 2.

Further, when the process cartridge 3 is mounted in the main casing 2, the process cartridge 3 is placed in the first position to allow the second opening 55A to communicate with the third opening 64A of the main-casing toner conveying part 83 after the process cartridge 3 is inserted into the main casing 2.

As a result, the process cartridge 3 can be more smoothly mounted in and removed from the main casing 2 in a state where the third opening 64A of the main-casing toner conveying part 83 is out of communication with the second opening 55A.

(9) According to the image forming apparatus 1, as shown in FIG. 12, the main casing 2 includes the main-casing guide parts 74 that slope forward toward top sides thereof. The process cartridge 3 is guided by the main-casing guide parts 74 when mounted in and removed from the main casing 2.

Accordingly, the process cartridges 3 can be reliably mounted in and removed from the main casing 2 without interfering with the main-casing toner conveying part 83 as the main-casing guide parts 74 guide the process cartridge 3 so that the process cartridge 3 passes in front of the main-casing toner conveying part 83.

As a result, the process cartridge 3 can be more smoothly mounted in and removed from the main casing 2.

(10) According to the image forming apparatus 1, as shown in FIG. 2, the main casing 2 includes the main-casing toner conveying part 83 that connects the first toner conveying part 92 of the toner cartridge 18 and the second toner conveying part 51 of the process cartridge 3.

Accordingly, even if the toner cartridge 18 is disposed away from the process cartridge 3, the toner cartridge 18 can be connected to the process cartridge 3 by the main-casing toner conveying part 83.

As a result, degree of freedom in layout of the toner cartridge 18 and the process cartridge 3 can be enhanced.

(11) According to the image forming apparatus 1, as shown in FIG. 10, the main-casing toner conveying part 83 includes the wall 64 having the third opening 64A that faces the second opening 55A. The wall 64 slopes forward toward a top side thereof.

Accordingly, communication between the second opening 55A and the third opening 64A can be easily interrupted by moving the second opening 55A diagonally rearward and downward.

Specifically, in the process cartridge 3, the second opening 55A is positioned at an upper-rear end portion of the process cartridge 3. Hence, the second opening 55A can be moved diagonally rearward and downward by pivotally moving the process cartridge 3 clockwise in a right side view. Consequently, communication between the second opening 55A and the third opening 64A can be easily interrupted.

Further, as shown in FIG. 12, the main-casing guide parts 74 that guide mounting and removing of the process cartridge 3 relative to the main casing 2 extends in a direction from upper front to lower rear. That is, a contacting direction between the seal 59 of the process cartridge 3 and the seal 66 of the main-casing toner conveying part 83 is substantially perpendicular to a mounting-removing direction of the process cartridge 3.

Accordingly, in a state where the seal 59 of the process cartridge 3 is in contact with the seal 66 of the main-casing toner conveying part 83, the process cartridge 3 cannot be moved diagonally upward and forward due to friction between the seal 59 and the seal 66.

However, the seal 59 can be easily separated from the seal 66 by pivotally moving the process cartridge 3 clockwise in a right side view. Thus, the process cartridge 3 can smoothly be removed from and mounted in the main casing 2.

(12) According to the image forming apparatus 1, as shown in FIG. 11, the main casing 2 includes the toner discharge part 84 connected to the drum cleaners 32. The toner discharge part 84 has the discharge openings 106A. The discharge opening 106A is positioned opposite the corresponding developing roller 15 with respect to the corresponding photosensitive drum 12 in the front-rear direction. In other words, the discharge opening 106A is positioned diagonally rearward and downward of the corresponding photosensitive drum 12.

Accordingly, connection between the drum cleaners 32 and the toner discharge part 84 can be easily interrupted by moving the corresponding process cartridges 3 forward.

As a result, the process cartridge 3 can be smoothly mounted in and removed from the main casing 2.

(13) According to the image forming apparatus 1, as shown in FIGS. 2 and 11, the second opening 55A is positioned further rightward than the discharge opening 106A.

Accordingly, toner can be supplied to the process cartridge 3 at a position outward of the discharge opening 106A in the left-right direction.

7. Variations

In the above-described embodiment, the secondary transfer roller 6 is exemplified as the secondary transfer member. However, an endless belt may be employed in place of the secondary transfer roller 6.

In the above-described embodiment, the charging roller 13 is exemplified as the charging member. However, a non-contact type charger that does not require contact with the photosensitive drum 12, such as a scorotron charger, may be used in place of the charging roller 13.

While the description has been made in detail with reference to the embodiments thereof, it would be apparent to those skilled in the art that many modifications and variations may be made therein without departing from the spirit of the disclosure.

What is claimed is:

1. An image forming apparatus comprising:

a main casing having an opening, the main casing including a cover configured to pivotally move about a pivot axis to open and close the opening;

a process cartridge detachably mountable in the main casing, the process cartridge including a photosensitive drum and a developing roller;

a transfer belt positioned upward of the process cartridge and in contact with the photosensitive drum when the process cartridge has been mounted in the main casing, the transfer belt having one end and another end in an orthogonal direction orthogonal to a vertical direction and an axial direction of the photosensitive drum, the pivot axis being positioned closer to the one end of the transfer belt than to the another end of the transfer belt in the orthogonal direction;

a toner cartridge configured to accommodate toner to be supplied to the process cartridge and detachably mountable in the main casing, the toner cartridge being positioned upward of the process cartridge when the process cartridge and the toner cartridge have been mounted in the main casing;

a secondary transfer member in contact with the one end of the transfer belt;

a fixing unit including a heating body and a pressure body, the fixing unit being positioned closer to the one end of the transfer belt than to the another end of the transfer belt in the orthogonal direction;

a first toner conveying part provided at the toner cartridge and having a first opening; and a second toner conveying part provided at the process cartridge and having a second opening configured to communicate with the first opening, the second opening being positioned opposite the developing roller with respect to the photosensitive drum in the orthogonal direction.

2. The image forming apparatus according to claim 1, wherein the second toner conveying part includes:

a first portion extending downward from the second opening and having a lower end portion; and a second portion extending in the orthogonal direction from the lower end portion of the first portion, the second portion being positioned downward of the photosensitive drum.

3. The image forming apparatus according to claim 2, wherein the process cartridge further includes a charging member configured to charge a surface of the photosensitive drum, and wherein the second portion of the second toner conveying part overlaps the charging member when viewed in the axial direction.

4. The image forming apparatus according to claim 1, wherein the second opening of the second toner conveying part is positioned outward of the developing roller in the axial direction.

5. The image forming apparatus according to claim 1, wherein the process cartridge comprises:

a drum unit supporting the photosensitive drum; and a developing unit supporting the developing roller, the developing unit being pivotally movable between a contact position where the developing roller is in contact with the photosensitive drum and a separated position where the developing roller is separated from the photosensitive drum, and wherein the second toner conveying part comprises:

a third toner conveying part supported at the drum unit, the second opening being formed in the third toner conveying part; and a fourth toner conveying part supported at the developing unit, the fourth toner conveying part connecting the developing unit and the third toner conveying part, the fourth toner conveying part being movable relative to the third toner conveying part.

6. The image forming apparatus according to claim 5, wherein the second toner conveying part further comprises a connecting member connecting the third toner conveying part and the fourth toner conveying part.

7. The image forming apparatus according to claim 6, wherein the connecting member is formed of a sponge.

8. The image forming apparatus according to claim 1, wherein the process cartridge is pivotally movable inside the main casing about an axis of the photosensitive drum between a first position providing communication between the first opening and the second opening and a second position interrupting communication between the first opening and the second opening.

9. The image forming apparatus according to claim 1, wherein the main casing includes a plurality of main-casing guide parts configured to guide the process cartridge when the process cartridge is mounted in and removed from the main casing, wherein the orthogonal direction is a direction from the one end of the transfer belt toward the another end of the transfer belt, and wherein each of the plurality of main-casing guide parts slopes upward in the orthogonal direction.

10. The image forming apparatus according to claim 9, wherein the main casing includes a main-casing toner conveying part connecting the first toner conveying part and the second toner conveying part.

11. The image forming apparatus according to claim 10, wherein the main-casing toner conveying part includes a wall having a third opening facing the second opening, the wall sloping upward in the orthogonal direction.

12. The image forming apparatus according to claim 1, wherein the process cartridge further includes a drum cleaner in contact with the photosensitive drum, and wherein the main casing includes a toner discharge part connected to the drum cleaner, the toner discharge part having a discharge opening positioned opposite the developing roller with respect to the photosensitive drum in the orthogonal direction.

13. The image forming apparatus according to claim 12, wherein the second opening is positioned outward of the discharge opening in the axial direction.

14. A process cartridge detachably mountable in an image forming apparatus and comprising a developing roller and a photosensitive drum, the image forming apparatus comprising:

a main casing having an opening, the main casing including a cover configured to pivotally move about a pivot axis to open and close the opening;

a transfer belt positioned upward of the process cartridge and in contact with the photosensitive drum when the process cartridge has been mounted in the main casing, the transfer belt having one end and another end in an orthogonal direction orthogonal to a vertical direction and an axial direction of the photosensitive drum, the pivot axis being positioned closer to the one end of the transfer belt than to the another end of the transfer belt in the orthogonal direction;

a toner cartridge configured to accommodate toner to be supplied to the process cartridge and detachably mountable in the main casing, the toner cartridge being positioned upward of the process cartridge when the process cartridge and the toner cartridge have been mounted in the main casing, the toner cartridge including a first toner conveying part having a first opening;

a secondary transfer member in contact with the one end of the transfer belt; and a fixing unit including a heating body and a pressure body, the fixing unit being positioned closer to the one end of the transfer belt than to the another end of the transfer belt in the orthogonal direction, the process cartridge detachably mountable in the main casing and further comprising a second toner conveying part having a second opening, the second opening being configured to communicate with the first opening and positioned opposite the developing roller with respect to the photosensitive drum.

* * * * *